US009376883B2

(12) United States Patent
Nguyen et al.

(10) Patent No.: US 9,376,883 B2
(45) Date of Patent: Jun. 28, 2016

(54) SYSTEMS, METHODS, AND DEVICES FOR ISOLATING PORTIONS OF A WELLHEAD FROM FLUID PRESSURE

(71) Applicant: Cameron International Corporation, Houston, TX (US)

(72) Inventors: Dennis P. Nguyen, Pearland, TX (US); Jay Patrick Painter, Webster, TX (US); Kirk Paul Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 253 days.

(21) Appl. No.: 13/975,328

(22) Filed: Aug. 24, 2013

(65) Prior Publication Data

US 2014/0060810 A1 Mar. 6, 2014

Related U.S. Application Data

(63) Continuation of application No. 12/391,977, filed on Feb. 24, 2009, now Pat. No. 8,899,315.

(60) Provisional application No. 61/031,331, filed on Feb. 25, 2008, provisional application No. 61/142,133, filed on Dec. 31, 2008.

(51) Int. Cl.

| | |
|---|---|
| ***E21B 33/03*** | (2006.01) |
| ***E21B 33/068*** | (2006.01) |
| ***E21B 33/04*** | (2006.01) |
| ***E21B 23/00*** | (2006.01) |

(52) U.S. Cl.

CPC ..... *E21B 33/068* (2013.01); *E21B 23/00* (2013.01); *E21B 33/03* (2013.01); *E21B 33/04* (2013.01)

(58) Field of Classification Search

CPC ..... E21B 33/03; E21B 33/04; E21B 33/068; E21B 17/1007

See application file for complete search history.

(56) References Cited

U.S. PATENT DOCUMENTS

| | | | |
|---|---|---|---|
| 3,171,674 | A | 3/1965 | Bickel et al. |
| 3,240,511 | A | 3/1966 | Bishop et al. |
| 3,268,242 | A | 8/1966 | Bishop et al. |

(Continued)

FOREIGN PATENT DOCUMENTS

| | | | |
|---|---|---|---|
| CN | 1401045 | A | 3/2003 |
| CN | 1730899 | A | 2/2006 |

(Continued)

OTHER PUBLICATIONS

Search Report & Written Opinion for Singapore Application No. 201107162-8 dated Apr. 28, 2014; 21 pages.

(Continued)

*Primary Examiner* — Robert E Fuller
(74) *Attorney, Agent, or Firm* — Fletcher Yoder, P.C.

(57) ABSTRACT

A wellhead system is provided. In one embodiment, the wellhead system includes a bypass sleeve for temporarily isolating portions of a wellhead assembly from pressurized fracing fluid. The bypass sleeve may include a generally tubular body having a tool interface, a lock ring disposed at least partially around the body, and an anti-rotation device coupled to the body. In some embodiments, the anti-rotation device includes a resilient member disposed in a cavity in the body, and an anti-rotation member biased away from the body by the resilient member. The anti-rotation member of some embodiments extends radially outward from the body.

10 Claims, 30 Drawing Sheets

(56) References Cited

U.S. PATENT DOCUMENTS

| | | | | |
|---|---|---|---|---|
| 3,661,206 | A | 5/1972 | Putch et al. | |
| 4,003,434 | A | 1/1977 | Garrett et al. | |
| 4,121,660 | A | 10/1978 | Koleilat | |
| 4,262,748 | A | 4/1981 | Kirkland | |
| 4,284,142 | A | 8/1981 | Kirkland | |
| 4,289,199 | A | 9/1981 | McGee | |
| 4,290,483 | A | 9/1981 | Lawson | |
| 4,451,056 | A | 5/1984 | Galle | |
| 4,465,134 | A | 8/1984 | Watkins | |
| 4,496,162 | A | 1/1985 | McEver | |
| 5,069,288 | A | 12/1991 | Signeetham | |
| 5,287,925 | A * | 2/1994 | Watkins | E21B 33/0422 166/208 |
| 5,509,476 | A | 4/1996 | Vick, Jr. | |
| 6,039,119 | A | 3/2000 | Hopper et al. | |
| 6,571,877 | B1 | 6/2003 | Van Bilderbeek | |
| 6,695,059 | B2 | 2/2004 | Thomas et al. | |
| 6,749,018 | B1 | 6/2004 | Ford et al. | |
| 7,308,934 | B2 | 12/2007 | Swagerty et al. | |
| 7,743,824 | B2 | 6/2010 | Lam et al. | |
| 2002/0170721 | A1 | 11/2002 | June | |
| 2006/0185841 | A1 | 8/2006 | Swagerty et al. | |
| 2008/0083539 | A1 * | 4/2008 | Hickie | E21B 33/068 166/379 |
| 2008/0230226 | A1 * | 9/2008 | Lam | E21B 43/26 166/308.1 |

FOREIGN PATENT DOCUMENTS

| | | |
|---|---|---|
| GB | 2222858 | 3/1990 |
| GB | 2287267 | 9/1995 |
| GB | 2469966 | 3/2009 |
| GB | 2487865 | 8/2012 |
| GB | 2491767 | 12/2012 |

OTHER PUBLICATIONS

Fourth Chinese Office Action; Application No. CN200980103703.4; Dated Jul. 8, 2014; 3 pages.
EP Combined Search and Examination Report; Application No. GB1217238.3; Dated Oct. 9, 2012; 5 pages.
PCT International Search Report and Written Opinion; Application No. PCT/US2009/035143; Dated Jun. 29, 2009; 15 pages.
EP Combined Search and Examination Report; Application No. GB1207324.3; Dated May 31, 2012; 5 pages.
EP Examination Report; Application No. GB1013651.3; Dated Feb. 15, 2012; 2 pages.
Third Chinese Office Action; Application No. CN200980103703.4; Dated Nov. 13, 2013; 6 pages.
First Chinese Office Action; Application No. CN200980103703.4; Dated Aug. 14, 2012; 9 pages.
Singapore Written Opinion; Application No. 2010048898-1; Dated Apr. 28, 2011; 7 pages.
Singapore Written Opinion; Application No. 201201312-4; Dated Jan. 23, 2014; 16 pages.
Search Report & Written Opinion for Singapore Application No. 201201312-4 mailed Dec. 12, 2013.

* cited by examiner

SYSTEMS, METHODS, AND DEVICES FOR ISOLATING PORTIONS OF A WELLHEAD FROM FLUID PRESSURE

CROSS REFERENCE TO RELATED APPLICATIONS

This application claims priority to and benefit of U.S. Non-Provisional patent application Ser. No. 12/391,977, entitled "Systems, Methods, and Devices for Isolating Portions of a Wellhead from Fluid Pressure," filed on Feb. 24, 2009, which is herein incorporated by reference in its entirety, which claims priority to and benefit of U.S. Provisional Patent Application No. 61/031,331, entitled "Systems, Methods, and Devices for Isolating Portions of a Wellhead from Fluid Pressure," filed on Feb. 25, 2008, which is herein incorporated by reference in its entirety, and also claims priority to and benefit of U.S. Provisional Patent Application No. 61/142,133, entitled "Systems, Methods, and Devices for Isolating Portions of a Wellhead from Fluid Pressure," filed on Dec. 31, 2008, which is herein incorporated by reference in its entirety.

FIELD OF THE INVENTION

The present invention relates generally to devices that couple to wellheads. More particularly, the present invention relates to devices configured to isolate portions of wellheads from fluid pressure.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are frequently used to extract fluids, such as oil, gas, and water, from subterranean reserves. These fluids, however, are often expensive to extract because they naturally flow relatively slowly to the well bore. Frequently, a substantial portion of the fluid is separated from the well by bodies of rock and other solid materials. These solid formations impede fluid flow to the well and tend to reduce the well's rate of production.

This effect, however, can be mitigated with certain well-enhancement techniques. Well output often can be boosted by hydraulically fracturing the rock disposed near the bottom of the well, using a process referred to as "fracing." To frac a well, a fracturing fluid is pumped into the well fast until the down-hole pressure rises, causing cracks to form in the surrounding rock. The fracturing fluid flows into the cracks and propagates them away from the well, toward more distant fluid reserves. To impede the cracks from closing after the fracing pressure is removed, the fracturing fluid typically carries a substance referred to as a proppant. The proppant is typically a solid, permeable material, such as sand, that remains the cracks and holds them at least partially open after the fracturing pressure is released. The resulting porous passages provide a lower-resistance path for the extracted fluid to flow to the well bore, increasing the well's rate of production.

Fracing a well often produces pressures in the well that are greater than the pressure-rating of certain well components. For example, some wellheads are rated for pressures up to 5,000 psi, a rating which is often adequate for pressures naturally arising from the extracted fluid, but some fracing operations can produce pressures that are greater than 10,000 psi. Thus, there is a need to protect some well components from fluid pressure arising from well fracing.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

Figure 1:
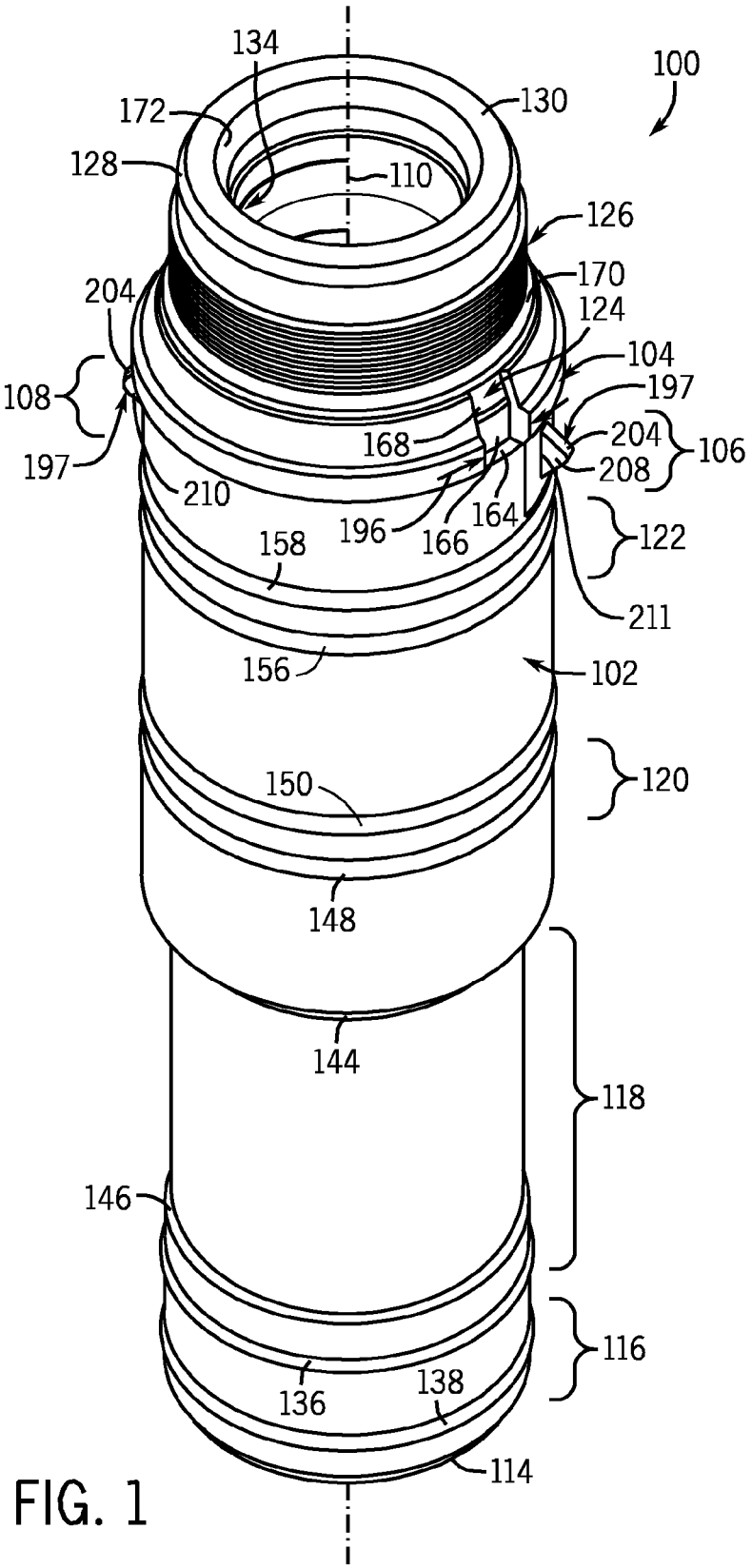
FIG. 1 is a perspective view of an example of a bypass sleeve in accordance with an embodiment of the invention.
Figure 2:
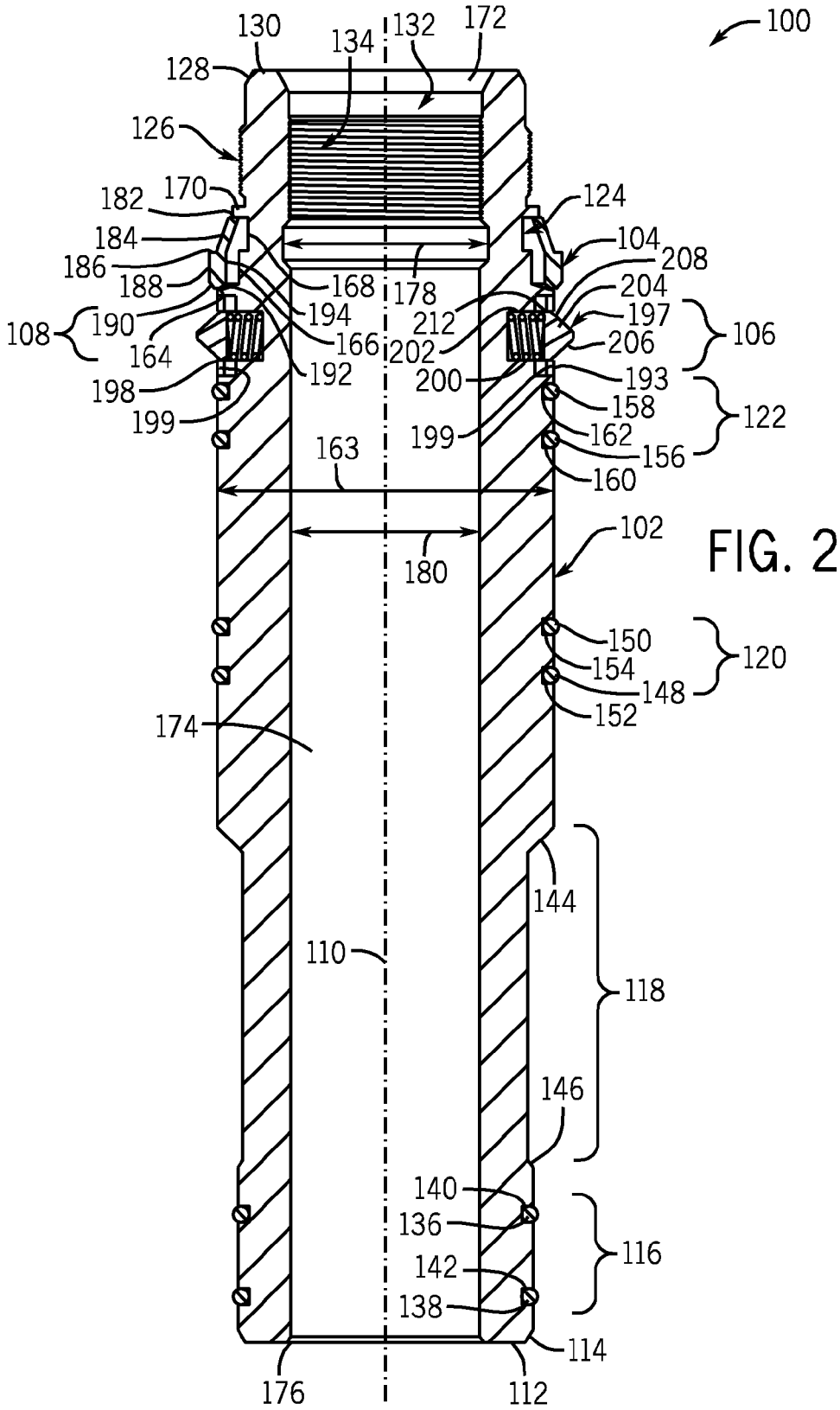
FIG. 2 is cross-sectional elevation view of the bypass sleeve of FIG. 1.

FIGS. 1 and 2 illustrate an example of a bypass sleeve 100. As explained below, the illustrated bypass sleeve 100 couples to a wellhead assembly and protects components of the wellhead assembly from fluid pressures that arise while fracing a well. After describing details of the bypass sleeve 100, an example of a wellhead assembly adapted to receive the bypass sleeve 100 is described with reference to FIGS. 3 and 4.

As illustrated by FIG. 2, the bypass sleeve 100 includes a body 102, a lock ring 104, and anti-rotation devices 106 and 108. In this embodiment, the body 102 has a generally tubular shape that is generally concentric about a central axis 110, and the body 102 includes the following features: a bottom edge 112, a lower chamfered surface 114, a lower seal assembly 116, a channel 118, an intermediate seal assembly 120, an upper a seal assembly 122, a lock-ring receptacle 124, a tool interface 126, an upper chamfered surface 128, a top edge 130, and an interior 132 having a pressure-barrier interface 134. In the illustrated embodiment, the bottom edge 112 is generally orthogonal to the central axis 110, and the lower chamfered surface 114 is generally defined by a sloped bottom corner of the body 102. The body 102 may be made of steel or other appropriate materials.

The illustrated lower seal assembly 116 includes two seal members 136 and 138 disposed in grooves 140 and 142. The illustrated channel 118 is a generally tubular recess in the body 102 with edges defined by shoulders 144 and 146. The channel 118 may cooperate with the wellhead assembly described below to generally define a volume around the body 102 that is in fluid communication with a valve for, among other things, relieving pressure in the wellhead assembly. The upper shoulder 144 functions as a landing surface for axially positioning the bypass sleeve in the wellhead assembly, though other features (such as the lower chamfered surface 114) may serve this purpose in other embodiments. The illustrated intermediate seal assembly 120 also includes two seal members 148 and 150 disposed in two grooves 152 and 154. Similarly, the illustrated upper seal assembly 122 includes two seal members 156 and 158 disposed in two grooves 160 and 162.

In the illustrated embodiment, the portion of the body 102 between the channel 118 and the lock-ring receptacle 124 is the widest portion of the body 102, having a diameter 163. To facilitate removal of the bypass sleeve 100 from a wellhead assembly, the widest diameter 163 may be smaller than or generally equal to interior diameters of components expected to be disposed above the bypass sleeve 100 in a wellhead assembly, components such as a blowout preventer, a christmas tree, or a frac tree, as explained below. Thus, in some embodiments, the bypass sleeve 100 is configured to be extracted through other components attached to a wellhead. Examples of a wellhead and examples of these components are described below after describing other features of the bypass sleeve 100.

In the present embodiment, the lock-ring receptacle 124 is a groove in the body 102 shaped to receive the lock ring 104. The illustrated lock-ring receptacle 124 includes a sloped surface 164 (e.g., conical at least partially about axis 110), an outer recess (e.g., annular at least partially about axis 110) 166, an inner recess (e.g., annular at least partially about axis 110) 168, and a rib 170. The outer recess 166 and the inner recess 168, in this embodiment, are generally parallel to the central axis 110, and the rib 170 extends generally perpendicular to the central axis 110. As explained below, the lock-ring receptacle 124 axially retains the lock ring 104 on the body 102 while allowing the lock ring 104 to expand and contract radially.

The illustrated tool interface 126 includes threads disposed near the top, external portion of the body 102. In this embodiment, the threads define the widest portion of the body 102 above the rib 170 to facilitate coupling the body 102 to a tool, as described below with reference to FIG. 6. In other embodiments, the tool interface 126, like the other threaded interfaces described herein, may include other structures configured to couple components, structures such as internal threads in the interior 132 of the body 102, another lock ring on the interior or exterior of the body 102, or other biased interlocking members, for example. The upper chamfered surface 128 is angled relative to the central axis 110 to guide the tool toward the tool interface 126, and the illustrated top edge 130 is generally perpendicular to the central axis 110.

In the present embodiment, the interior 132 of the body 102 includes a top chamfer 172, the pressure-barrier interface 134, a primary-flow passage 174, and a bottom chamfer 176. The illustrated pressure-barrier interface 134 includes threads disposed on an interior sidewall of the body 102. The threads are disposed in a top portion of the interior 132 that has an expanded diameter 178 relative to a diameter 180 of the primary-flow passage 174.

The primary-flow passage 174 defines a generally right, circular-cylindrical volume that is generally concentric about the central axis 110. In some embodiments, the diameter 180 of the primary-flow passage 174 is generally equal to or larger than minimum diameters of components disposed down-hole from the bypass sleeve 100, such as a tubing head, a casing hanger, or production casing. An interior diameter 180 with this property is believed to facilitate the movement of equipment and fluids between the interior 132 of the body 102 and down-hole components, as the diameter of the bypass sleeve 100 does not substantially constrain the axial movement of fluids and equipment that pass through other down-hole components. A bypass sleeve with this property is referred to as a "full bore" bypass sleeve.

The illustrated lock ring 104 is generally concentric about the central axis 110 and includes a top edge 182, a cam surface (e.g., conical at least partially about axis 110) 184, a top load shoulder 186, an outer sidewall (e.g., annular at least partially about axis 110) 188, a chamfer 190, a bottom load shoulder 192, an inner sidewall (e.g., annular at least partially about axis 110) 194, and a gap 196, which is illustrated by FIG. 1. As illustrated by the cross-section of FIG. 2, the top edge 182 and the load shoulder 192 cooperate with the rib 170 and the sloped surface 164 to generally axially restrain the lock ring 104 on the body 102. These structures 182, 192, 170, and 164 also cooperate to guide a radial movement of the lock ring 104 as the lock ring 104 is compressed and expanded, as explained below.

In this embodiment, the cam surface 184 is a generally sloped surface that generally defines a frusto-conical volume that is generally concentric about the central axis 110. The top load shoulder 186 may be a sloped, flat, or curved surface, and it is shaped to interface with components of a wellhead assembly to transmit vertical axial loads, e.g., loads from elevated fluid pressure in the well. These vertical loads may be transmitted between the body 102 and the lock ring 104 through the bottom load shoulder 192. Thus, in some embodiments, an upward axial force applied to the body 102 may be transmitted to the lock ring 104 through the bottom load shoulder 192 and to the wellhead assembly through the top load shoulder 186. Similarly, the chamfer 190 is configured to interface with components of the wellhead assembly to transmit vertical axial loads directed toward the well between the bypass sleeve 100 and the wellhead assembly, such as the weight of the bypass sleeve 100. The gap 196 is illustrated in FIG. 1. As explained below, the gap 196 allows the lock ring 104 to be compressed radially inward into the lock-ring receptacle 124. Other embodiments may include multi-piece lock rings 104 with more than one gap 196.

The anti-rotation devices 106 and 108 are generally similar or identical and oriented in opposite directions on the body 102. The illustrated bypass sleeve 100 includes two anti-rotation devices 106 and 108 disposed 180° apart at generally the same height on the body 102. Other embodiments may include more or fewer anti-rotation devices disposed at generally the same height or different heights with the same or different angular distributions around the body 102.

Each of the illustrated anti-rotation devices 106 and 108 includes an anti-rotation member 197, a restraining plate 198, a spring 200, and a cavity 202 in the body 102. The anti-rotation members 196 may be made of steel or other appropriate materials. In this embodiment, the anti-rotation members 196 include top and bottom cam surfaces 204 and 206, rotation-reduction surfaces 208 and 210, and a backing plate 212. In this embodiment, the top and bottom cam surfaces 204 and 206 are generally flat sloped surfaces, but in other embodiments, they may be curved or have some other shape. The rotation-reduction surfaces 208 and 210 in this embodiment are generally flat surfaces that are generally parallel to the central axis 110 and generally orthogonal to the cam surfaces 204 and 206. The rotation-reduction surfaces 208 and 210 and the cam surfaces 204 and 206 extend from the backing plate 212, which has a generally circular cylindrical shape that is generally complementary to the shape of the cavity 202. In some embodiments, the backing plate 212 may include a tubular sleeve that extends into the cavity 202, overlapping the spring 202, to transmit torque arising from forces applied to the cam surfaces 204 and 206.

The illustrated spring 202 is a helical compression spring, but in other embodiments other devices configured to actuate the anti-rotation members 196 may be used, for example, a linear motor, a pneumatic device, opposing magnets, elastomeric body, or other devices may be used in place of or in addition to the spring 200. The cavity 202 includes a generally right circular cylindrical volume that extends generally perpendicular to the central axis 110 into the body 102 and a recess for receiving the restraining plate 198. The illustrated restraining plates 198 are generally curved to generally match the outer surface of the body 102 and include an aperture 211. The anti-rotation member 197 may extend through an aperture 211, and the backing plate 212 may generally remain on the other side of the restraining plate 198.

In operation, as described below, the anti-rotation devices 106 and 108 interface with cavities in a wellhead assembly to prevent or reduce rotation of the body 102 relative to the wellhead assembly. Further, as explained below, the anti-rotation members 196 may recess into the cavity 202 to allow the bypass sleeve 100 to move vertically.

Figure 3:
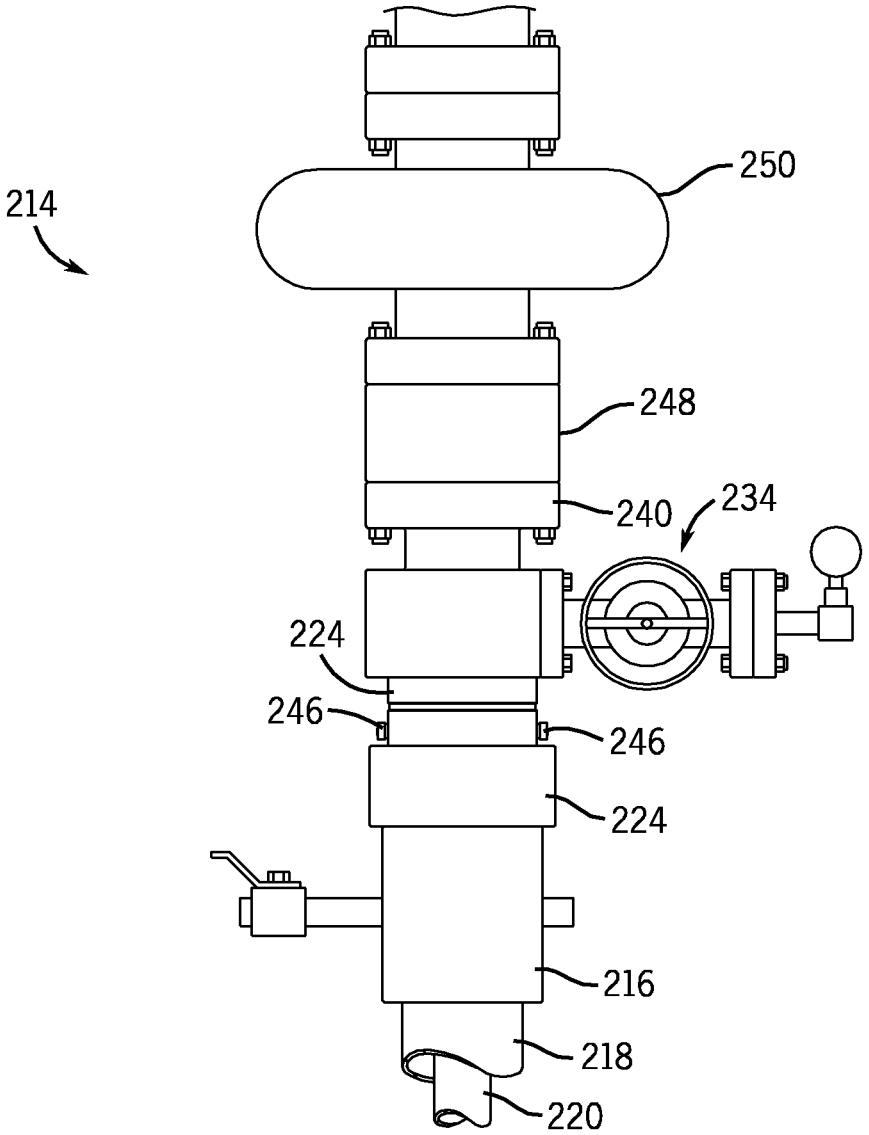
FIG. 3 is an elevation view of an example of a wellhead assembly adapted to receive the bypass sleeve of FIG. 1 in accordance with an embodiment of the invention.
Figure 4:
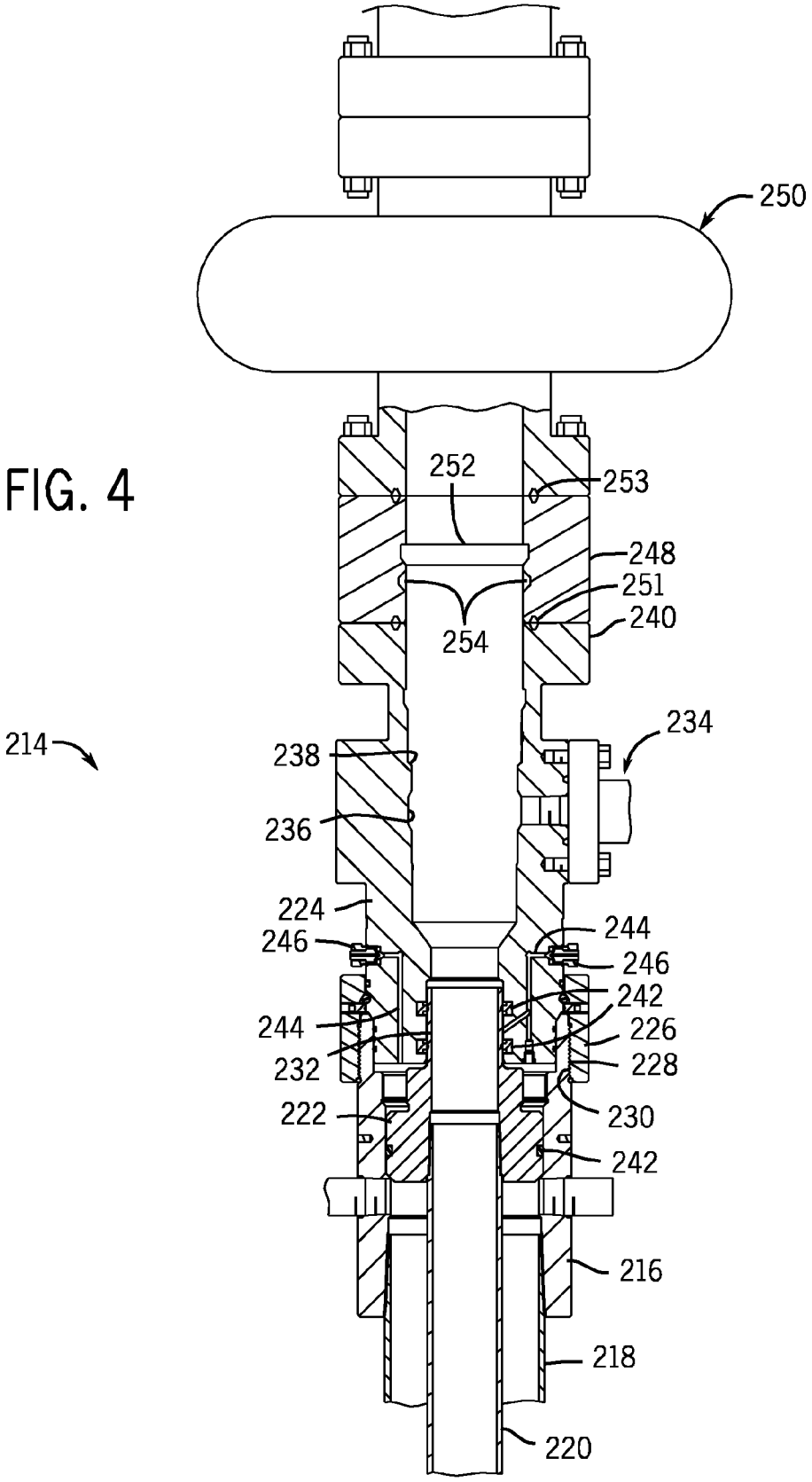
FIG. 4 is a cross-sectional elevation view of the wellhead assembly of FIG. 3.

An exemplary wellhead assembly 214 is provided in FIGS. 3 and 4 in accordance with one embodiment of the present invention. The illustrated wellhead assembly 214 is a surface wellhead, but the present technique is not limited to surface applications. Some embodiments may include a subsea tree. The exemplary wellhead assembly 214 includes a casing head 216 coupled to a surface casing 218. The wellhead assembly 214 also includes a production casing 220, which may be suspended within the casing head 216 and the surface casing 218 via a casing hanger 222. It will be appreciated that a variety of additional components may be coupled to the casing head 216 to facilitate production from a subterranean well.

For instance, in one embodiment, a tubing head 224 (also referred to as a "tubing spool") is coupled to the casing head 216. In the presently illustrated embodiment, the tubing head 224 is coupled to the casing head 216 via a union nut 226, which is threaded onto the casing head 216 via complementary threaded surfaces 228 and 230. Of course, it will be appreciated that wellhead members, such as the tubing head 224, may be coupled to the casing head 216 in any suitable manner, including through the use of various other connectors, collars, or the like. In one embodiment, the tubing head 224 may be adapted to receive an extended portion 232 of the casing hanger 222.

A valve assembly 234 is coupled to the exemplary tubing head 224 and may serve various purposes, including releasing pressure from an internal bore 236 of the tubing head 224. The internal bore 236 of the tubing head 224 is configured to receive one or more additional wellhead members or components, such as the bypass sleeve 100 described above. As will be appreciated, operating pressures within the wellhead assembly 214 are typically greater during a fracturing process than during ordinary production. In order to protect components of the wellhead assembly 214 having a lower pressure rating (i.e., below the expected fracturing pressure) from such excessive pressure, the bypass sleeve 100 may be introduced within the bore 236 to isolate the portions of the wellhead assembly 214 from at least some of this pressure.

The exemplary tubing head 224 includes a sloped landing surface 238 configured to abut the shoulder 144 of the bypass sleeve 100 (FIG. 2). In some embodiments, these structures 144 and 238 cooperate to axially position the bypass sleeve 100 in the wellhead assembly 214, as explained below. The exemplary tubing head 224 also includes a flange 240 configured to facilitate coupling of various components or wellhead members.

The exemplary wellhead assembly 214 includes various seals 242 to isolate pressures within different sections of the wellhead assembly 214. For instance, as illustrated, such seals 242 include seals disposed between the casing head 216 and the casing hanger 222 and between the casing hanger 222 and the tubing head 224. Further, various components of the wellhead assembly 214, such as the tubing head 224, may include internal passageways 244 that allow testing of one or more of the seals 242. When not being used for such testing, these internal passageways 244 may be sealed from the exterior via pressure barriers 246.

The illustrated wellhead assembly 214 also includes an adapter 248 and a blow-out preventer 250. The adapter 248 couples to the tubing head 224 via the flange 240. In this embodiment, the adapter 248 includes a lock-ring receptacle 252 and anti-rotation interfaces 254. The illustrated lock-ring receptacle 252 is a generally circular groove that is generally complementary to the lock ring 104. In this embodiment, the anti-rotation interfaces 254 are recesses that are generally complementary to the anti-rotation members 197 of FIGS. 1 and 2.

The illustrated blowout preventer 250 couples to the wellhead assembly 214 via the adapter 248. The blowout preventer 250 includes a valve and a valve actuator, such as a hydraulic actuator, configured to close the valve. The blowout preventer 250 is configured to close the bore 236 if the pressure in the bore 236 exceeds some threshold condition. In other embodiments, other devices may be connected to the flange 240 or the adapter 248. For example, a christmas tree or a frac tree may be connected to one of these components.

Figure 5:
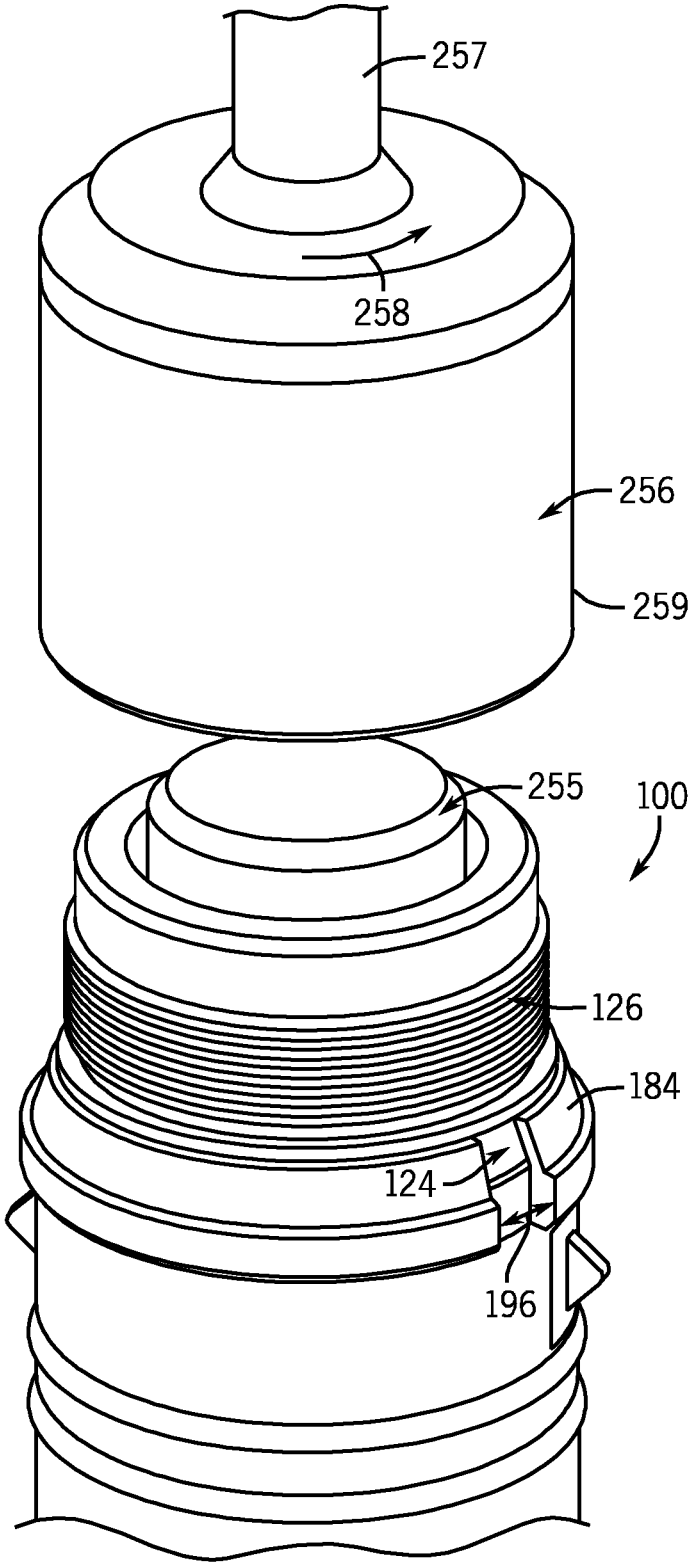
FIGS. 5-7 illustrate the bypass sleeve of FIG. 1 being prepared for installation in the wellhead assembly of FIG. 3.

FIGS. 5-11 illustrate steps in a process for installing the bypass sleeve 100 of FIG. 1 in the wellhead assembly 214 of FIG. 3. As illustrated by FIG. 5, a pressure barrier 255 is initially installed in the bypass sleeve 100. The illustrated pressure barrier 255 is threaded into the thread interface 134 of the bypass sleeve 100, but in other embodiments, these components 255 and 100 may be joined with other techniques. In some embodiments, the pressure barrier 255 is a check valve configured to obstruct fluid flowing out of the well, or in other embodiments, the pressure barrier 255 is a member that obstructs fluids flowing in both directions.

Figure 6:
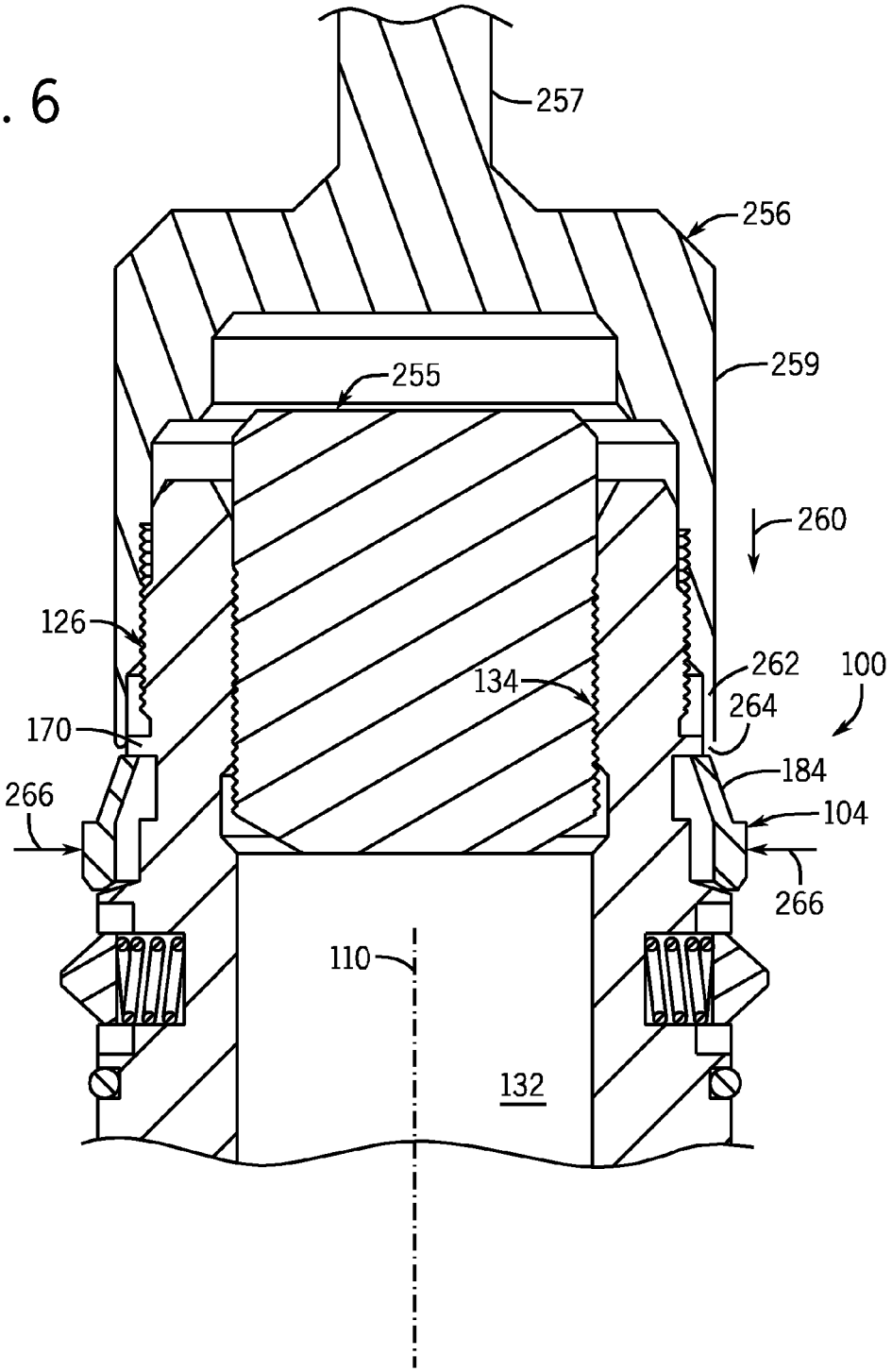
Figure 7:
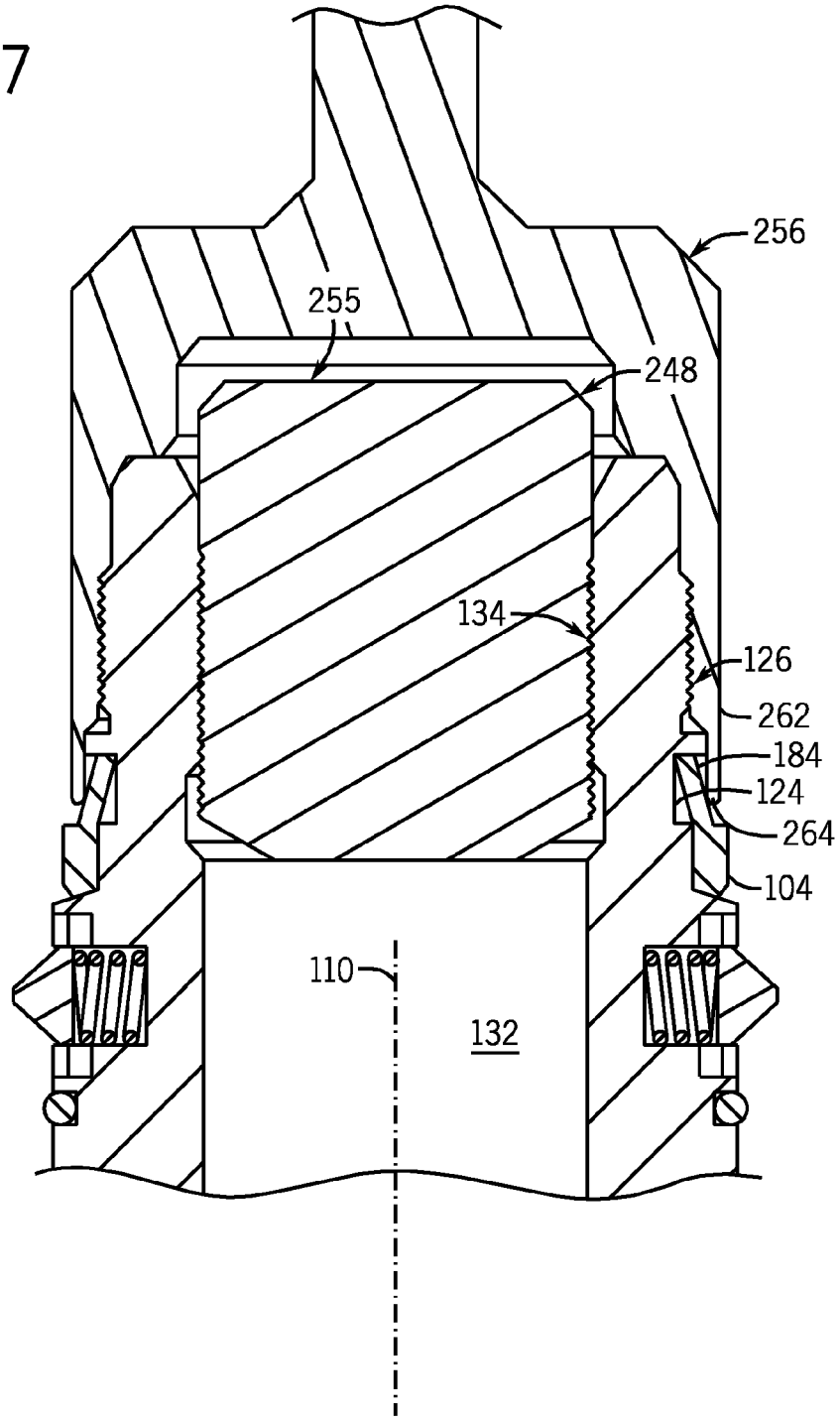

FIG. 5 also illustrates a tool 256 proximate the bypass sleeve 100. The tool 256 couples to the bypass sleeve 100 via the tool interface 126, as illustrated by FIG. 6. The tool 256 rotates relative to the bypass sleeve 100, as illustrated by arrow 258 in FIG. 5, and translates along the central axis 110, as illustrated by arrow 260 in FIG. 6. The illustrated tool 256 includes a tubular distal portion 262 that is sized to overlap the rib 170. As the tool 256 translates, a contact surface 264 at the end of the distal portion 262 contacts the cam surface 184 of the lock ring 104. The contact surface 264 slides along the cam surface 184 and compresses the lock ring 104 radially inward, as illustrated by arrow 266, until the lock ring 104 is in the contracted position illustrated by FIG. 7 and the lock ring 104 is partially or substantially entirely recessed into the lock-ring receptacle 124. As the lock ring 104 contracts generally radially inward, the gap 196 illustrated in FIG. 5 decreases and the lock ring 104 is biased.

Figure 8:
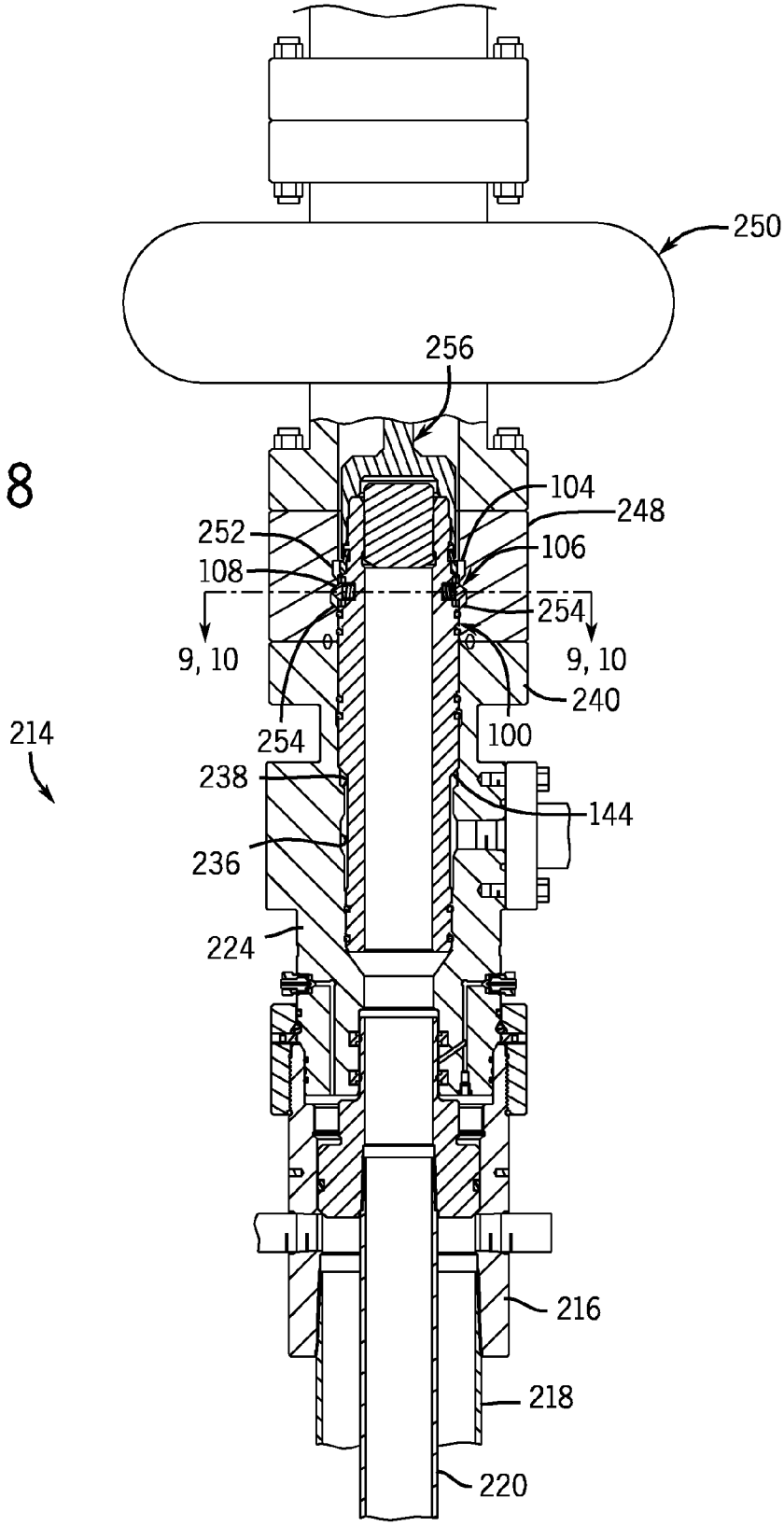
FIGS. 8-11 illustrate the bypass sleeve of FIG. 1 being installed in the wellhead assembly of FIG. 3.

Next, the bypass sleeve 100 may be positioned in the wellhead assembly 214, as illustrated by FIG. 8. The tool 256 lowers the bypass sleeve 100 into the wellhead assembly 214 through the blowout preventer 250 and the adapter 248. The lock ring 104 remains in the compressed position illustrated by FIG. 7 while the bypass sleeve 100 is lowered into the wellhead assembly 214. To accommodate features in the wellhead assembly 214 that are narrower than the distal portions of the anti-rotation devices 106 and 108, the anti-rotation members 197 may partially or substantially entirely recessed into the cavities 202, compressing the spring 200. The movement of these components is described further below with reference to FIGS. 9, 10, and 12. In some embodiments, the tool 256 lowers the bypass sleeve 100 until the shoulder 144 of the bypass sleeve 100 contacts the sloped landing surface 238 of the tubing head 224. The height of these features 144 and 238 position the anti-rotation devices 106 and 108 at generally the same height as the anti-rotation interfaces 254, and the lock ring 104 may be positioned at generally the same height as the lock-ring receptacle 252 in the adapter 248.

Figure 9:
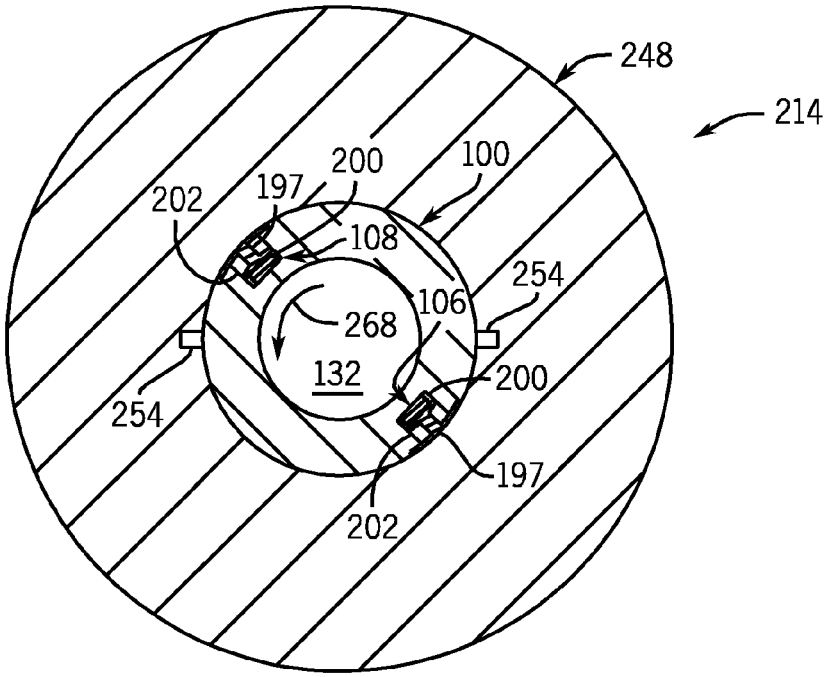

While the anti-rotation devices 106 and 108 are generally axially aligned with the anti-rotation interfaces 254, these features may not be rotationally aligned, as illustrated by FIG. 9. As mentioned above, the anti-rotation members 197 recessed into the cavity 202, compressing the spring 200 to accommodate features of the wellhead assembly 214. To impede rotation of the bypass sleeve 100 relative to the wellhead assembly 214, the anti-rotation devices 106 and 108 engage the anti-rotation interfaces 254 in the adapter 248. If the bypass adapter 100 begins to rotate within the wellhead assembly 214, as might occur when disengaging the tool 256, at some point within 180° of rotation, the anti-rotation devices 106 and 108 will engage the anti-rotation interfaces 254 and impede further rotation. Rotation of the bypass sleeve 100 is illustrated by arrow 268 in FIG. 9, and the anti-rotation devices 106 and 108 are illustrated in the disengaged position in FIG. 9.

Figure 10:
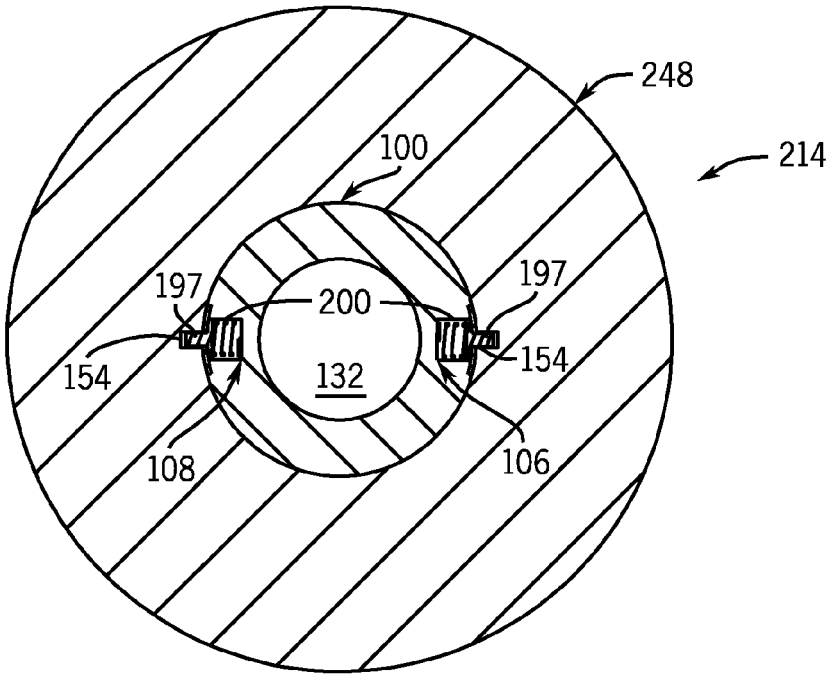

FIG. 10 illustrates the anti-rotation devices 106 and 108 in the engaged position. As the bypass sleeve 100 rotates, eventually the anti-rotation members 197 align with the anti-rotation interfaces 254. When they are aligned, the anti-rotation members 197 are driven into the anti-rotation interfaces 254 by the springs 200. In some embodiments, the anti-rotation members 197 may be characterized as having a single degree of freedom relative to the bypass sleeve 100. Once engaged, the rotation-reduction surfaces 208 and 210 may receive forces from the vertical surfaces of the anti-rotation interfaces 254 that produced torques tending to counteract rotation of the bypass sleeve 100.

Other embodiments may omit the anti-rotation devices 106 and 108 or they may include other in types of anti-rotation devices. For example, in some embodiments, the anti-rotation devices 106 and 108 may be disposed on the adapter 248 and the anti-rotation interfaces 254 may be disposed on the bypass sleeve 100. In some embodiments, a friction member similar to a drum break may interface between the bypass sleeve 100 and other components of the wellhead assembly 214 to reduce rotation. The illustrated anti-rotation devices 108 and 106 include components that translate generally radially. Other embodiments may include members to translate generally axially. For example, the anti-rotation members 106 and 108 may be disposed near the bottom edge 112 (FIG. 2), and the anti-rotation members 197 may translate axially downward to engage an anti-rotation interface in the tubing head 224.

The anti-rotation devices 106 and 108 are believed to facilitate removal of the tool 256 and the pressure barrier 255 (FIG. 5) from the bypass sleeve 100. As explained above, the tool 256 and the pressure barrier 255 engage the bypass sleeve 100, in some embodiments, through threaded couplings. Thus, to disengage these components, they are typically rotated relative to one another. The anti-rotation devices 106 and 108 tend to prevent the bypass sleeve 100 from rotating with the tool 256, thereby facilitating relative rotation in some embodiments.

Figure 11:
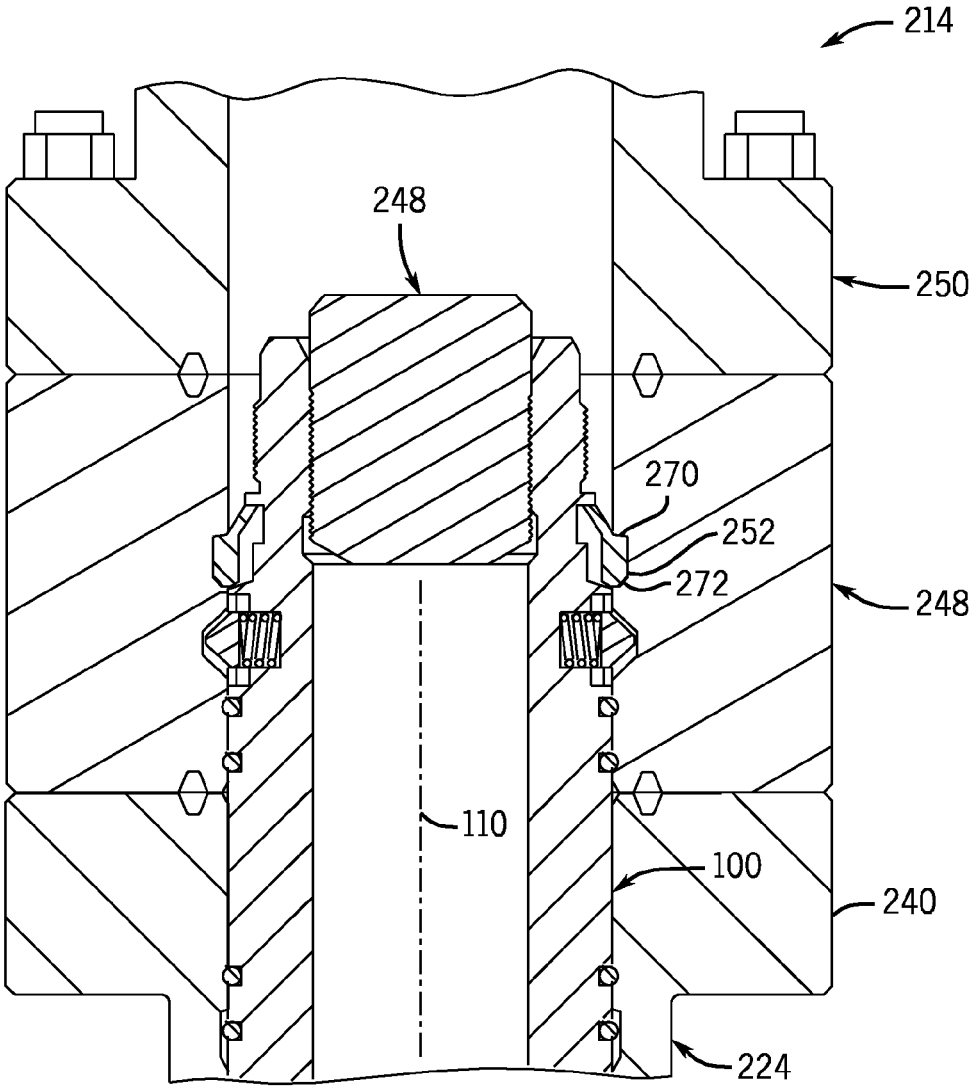

FIG. 11 illustrates the bypass sleeve 100 in the installed position. To complete installation and position the bypass sleeve 100 as illustrated by FIG. 11, the tool 256 (FIG. 8) is rotated relative to the bypass sleeve 100. As the tool 256 rotates, the distal portion 262 (FIG. 7) translates axially away from the lock ring 104, and the lock ring 104 expands radially into the lock-ring receptacle 252. The lock-ring receptacle 252 includes upper and lower shoulders 270 and 272 that impede the bypass sleeve 100 from the translating axially. In some embodiments, the lock ring 104 is not completely relaxed and is biased radially inward by the lock-ring receptacle 252.

Figure 12:
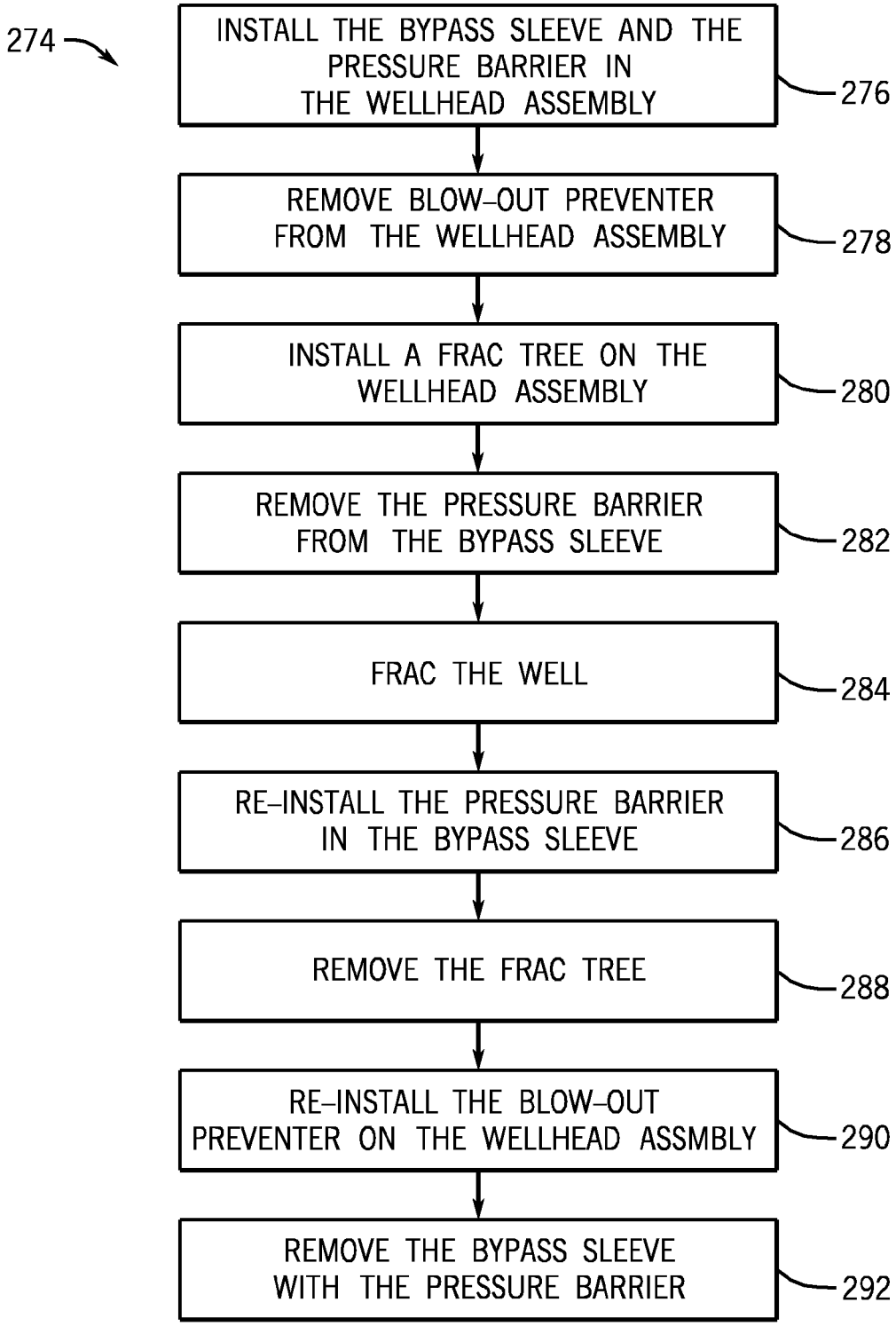
FIG. 12 illustrates a fracing process in accordance with an embodiment of the invention.

The installation process illustrated by FIGS. 5-11 is the first step in an example of a process 274 for fracing a well illustrated by FIG. 12. In this figure, the process for installing the bypass sleeve is illustrated by box 276. After installing the bypass sleeve, the blowout preventer 250 is removed from the wellhead assembly 214, as illustrated by block 278. As noted above, the pressure barrier 255 generally seals to the bypass sleeve 100, and the bypass sleeve 100 generally seals to the tubing head 224. As a result, in some embodiments, the well is generally sealed while removing the blowout preventer 250.

Next, a frac tree or other frac-related equipment is coupled to the wellhead assembly 214, as illustrated by block 280. In some embodiments, this step includes coupling tracking equipment to the flange 240 of the wellhead assembly 214 illustrated in FIG. 4. As will be appreciated, the frac tree may include valves or caps that tend to confine pressure in the wellhead assembly 214 above the pressure barrier 255. Next, the pressure barrier 255 is removed from the bypass sleeve 100, as illustrated by block 282. Removing the pressure barrier 255 may include passing another tool through the frac tree and unthreading or otherwise disengaging the pressure barrier 255 from the bypass sleeve 100. During this step, in embodiments incorporating the embodiment of FIG. 2, the anti-rotation devices 106 and 108 may again prevent the bypass sleeve 100 from rotating with the pressure barrier 255.

After removing the pressure barrier 255, the frac equipment is in fluid communication with the production casing 220, and the well is fraced, as illustrated by block 284. As described above, fracing includes pumping a fluid into the well at a rate sufficient to elevate down-hole pressures and fracture subterranean rock formations. This act may be aided by features of the bypass sleeve 100 described above with reference to FIG. 2, inter alia. Because the inner diameter 180 of the bypass sleeve 100 is greater than or generally equal to the diameter of the production casing 220, in some embodiments, the fracing fluid is believed to have a relatively unobstructed flow path into the well. During this step, the bypass sleeve 100 protects portions of the wellhead assembly from fracing pressures, which may be greater than 5000 psi, 10,000 psi, 15,000 psi, or larger. In some embodiments, the bypass sleeve 100 protects portions of the wellhead assembly 214 of FIG. 8, e.g., the tubing head 224 or the joint between the adapter 248 and the flange 240.

After fracing the well, the pressure barrier 255 is reinstalled in the bypass sleeve 100, as illustrated by block 286. In some embodiments, reinstalling the pressure barrier 255 includes passing the pressure barrier 255 through the frac tree with one of the tools described above and threading or otherwise coupling the pressure barrier 255 to the bypass sleeve 100. Next, of the frac tree is removed, as illustrated by block 288, and the blowout preventer 250 or a christmas tree is reinstalled on the wellhead assembly 214, as illustrated by block 290.

Figure 13:
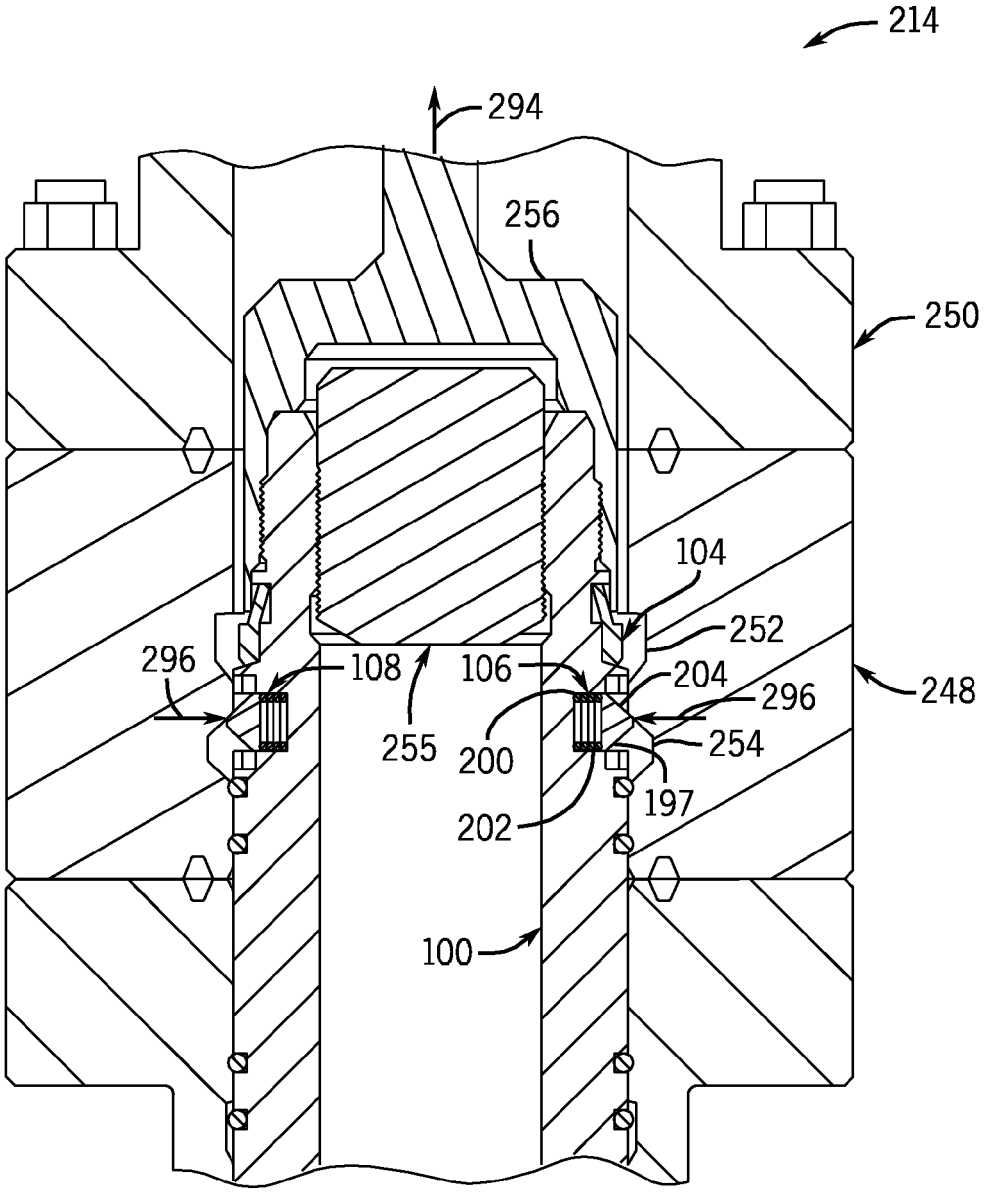
FIG. 13 illustrates the bypass sleeve of FIG. 1 being removed from the wellhead assembly of FIG. 3.

Finally, the bypass sleeve 100 is removed along with the pressure barrier 255, as illustrated by block 292. One way in which this step is performed is illustrated by FIG. 13. In this embodiment, the tool 256 is threaded back onto the bypass sleeve 100 while the anti-rotation devices 106 and 108 impede the bypass sleeve 100 from rotating with the tool 256. As the tool 256 threads on to the bypass sleeve 100, the tool 256 returns the lock ring 104 to the compressed position, as described above with reference to FIG. 6, thereby disengaging the lock ring 104 from the lock-ring receptacle 252.

Once the lock ring 104 is returned to the compressed position, the tool 256 is pulled generally axially upward along with the bypass sleeve 100, as illustrated by arrow 294. The upward movement of the anti-rotation devices 106 and 108 biases the anti-rotation members 197 against the anti-rotation interfaces 254, and the resulting force against the top cam surfaces 204 recesses the anti-rotation members 197 in the cavity 202, compressing the springs 200, as illustrated by arrows 296. Retracting the anti-rotation members 197 allows the bypass sleeve 100 to translate back through the blowout preventer 250 and exit the wellhead assembly 214.

During some embodiments of the fracing process 274 described above with reference to FIG. 12, the bypass sleeve 100 and the pressure barrier 255 are installed generally simultaneously and are removed generally simultaneously, e.g., in a single trip of the tool 256 into the wellhead assembly 214. One-trip installation and one-trip removal of the bypass sleeve 100 and pressure barrier 255 is believed to speed the fracing process 274 relative to fracing processes in which the pressure barrier 255 and the bypass sleeve 100 are installed in separate trips.

Further, during execution of some embodiments of the fracing process 274, the wellhead assembly 214 has a device installed that is adapted to contain fluid in the well while the blowout preventer 250 is removed. The pressure barrier 255 confines fluid to the well during portions of the fracing process 274, e.g., when the fracing tree or the blowout preventer 250 are not installed. This is believed to reduce blowouts.

The bypass sleeve 100 described above with reference to FIGS. 1 and 2 has an integrated sleeve restraint, i.e., the lock ring 104 and lock-ring receptacle 124, but other embodiments may include a non-integrated sleeve restraint. An example of such an embodiment is illustrated by FIG. 14, which depicts a bypass sleeve 304 and a separate sleeve restraint 302.

The sleeve restraint 302 and the bypass sleeve 304 include many of the same features as the bypass sleeve 100 described above. Accordingly, in the interest of the economy, the features that are similar are identified with the same reference number as was used above. Further, the bypass sleeve 304 is installed in a wellhead assembly 300 that includes many of the features of the wellhead assembly 214 described above with reference to FIG. 4, so the same reference numbers are used to identify features that are generally similar between the wellhead assemblies 214 and 300. This convention is followed throughout the written description.

The illustrated bypass sleeve 304 is impeded from axial-upward movement through the wellhead assembly 300 by the sleeve restraint 302. In this embodiment, the sleeve restraint 302 includes the previously-described lock ring 104, anti-rotation devices 106 and 108, lock-ring receptacle 124, tool interface 126, and many of the other features disposed near the top of the previously-described bypass sleeve 100 (FIG. 2). In the illustrated embodiment, the sleeve restraint 302 does not include the pressure-barrier interface 134, as this feature is disposed in the bypass sleeve 304. In other embodiments, the pressure-barrier interface 134 may be disposed partially or entirely in the sleeve restraint 302. To allow the pressure barrier 255 to reach the pressure-barrier interface 134, in some embodiments, the sleeve restraint 302 has a diameter 306 (e.g., a minimum diameter) that is larger than a diameter 308 of the pressure barrier 255.

Figure 14:
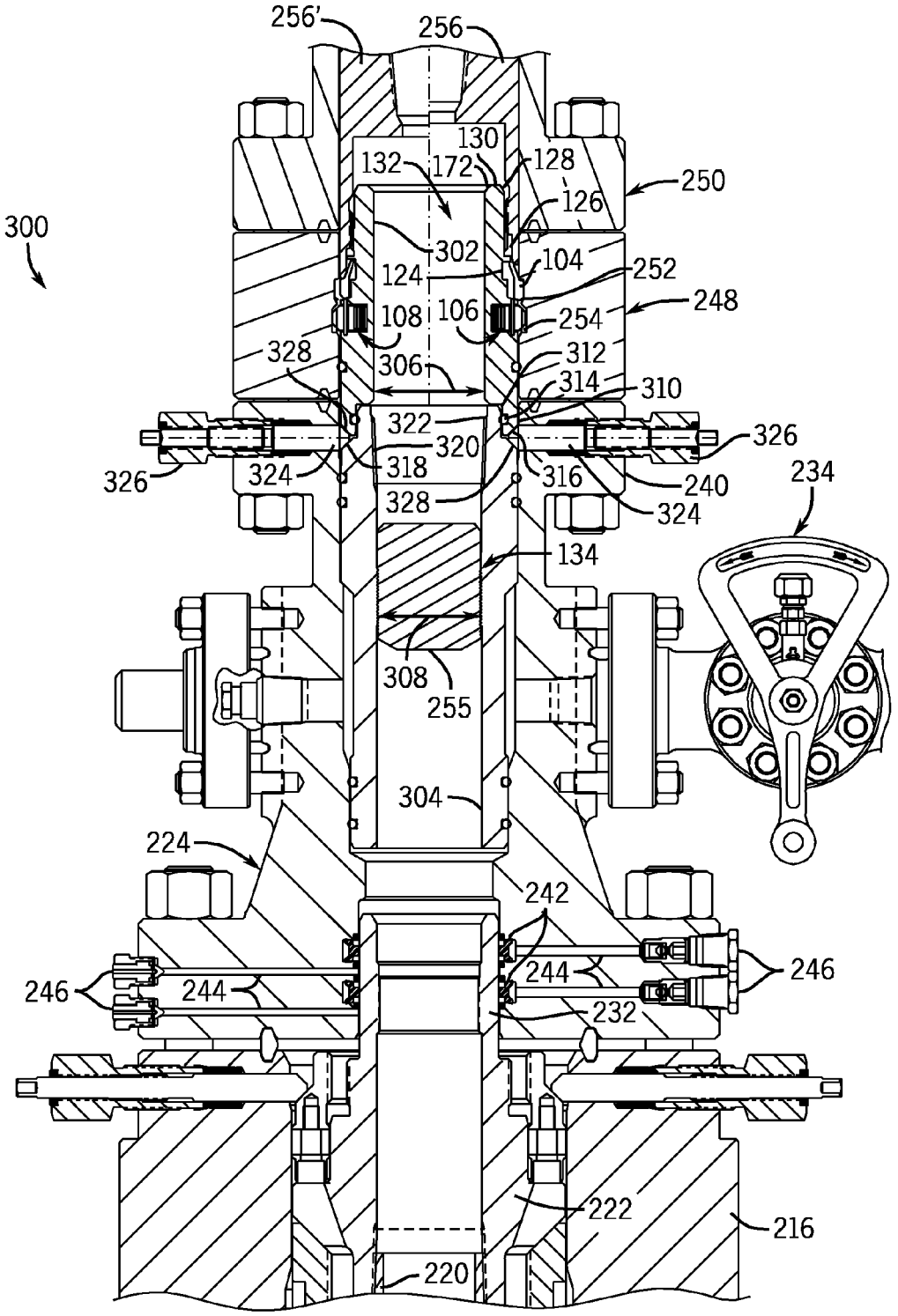
FIG. 14 illustrates a second example of a bypass sleeve in accordance with an embodiment of the invention.

The sleeve restraint 302 is shown in FIG. 14 in a split view, with each half depicting different stages of the sleeve restraint 302 interfacing with the tool 256. In the right portion of FIG. 14, the tool 256 is shown in a partially-retracted position, leaving the lock ring 104 in the expanded position, and in the left portion of FIG. 14, the tool 256' is shown in a fully-engaged position, compressing the lock ring 104 in the contracted position.

In this embodiment, the bottom portion of the sleeve restraint 302 includes a flange 310 that overlaps part of the bypass sleeve 304. The illustrated flange 310 is generally concentric about the central axis and generally has a tubular shape. The flange 310 includes a sealing member 312 disposed in a groove 314 in an inner surface of the flange 310. The flange 310 also includes a chamfered surface 316 that engages with lock pins that are described further below along with other details of the wellhead assembly 300.

The bypass sleeve 304 of the present embodiment includes a tubing-head interface 318, the pressure-barrier interface 134, another tool interface 320, and a flange 322 that overlaps and seals against the seal member 312 on the flange 310. The illustrated tubing-head interface 318 is a chamfered surface that is positioned to contact subsequently described locking pins in the wellhead assembly 300. In this embodiment, the tool interface 320 is a threaded inner surface of the bypass sleeve 304 with a diameter that is smaller than the diameter 306 of the sleeve restraint 302.

The illustrated wellhead assembly 300 includes locking pins 324 that are positioned to apply a force to the tubing-head interface 318. The locking pins 324 extend generally radially through the flange 240 in the tubing head 224. The illustrated locking pins 324 are threaded to two bushings 326 that are threaded to the flange 240. In this embodiment, the locking pins 324 include a chamfered tip 328 that contacts both the tubing-head interface 318 on the bypass sleeve 304 and the chamfered surface 316 on the sleeve restraint 302. The locking pins 324 may cooperate with the sleeve restraint 302 to hold the bypass sleeve 304.

In operation, the bypass sleeve 304 may be installed in the wellhead assembly 300 with a single trip or with two trips. For example, a tool with exterior threads configured to interface with the tool interface 320 may lower the bypass sleeve 304 and the pressure barrier 255 into the wellhead assembly 300, and then in a separate trip, the tool 256 may lower and install the sleeve restraint 302, using an installation process similar to that described above with reference to the bypass sleeve 100 of FIG. 2. In other embodiments, the sleeve restraint 302 and the bypass sleeve 304 may be installed while connected together in a single trip.

Once the bypass sleeve 304 is positioned in the wellhead assembly 300, the bushings 326 are rotated to drive the locking pins 324 radially inward, biasing the chamfered tip 328 against the tubing-head interface 318 and holding the bypass sleeve 304 in the wellhead assembly 300. The sleeve restraint 302 may interface with the adapter 248 to impede the bypass sleeve 304 from moving axially upward and the seals on the sleeve restraint 302 may protect the locking pins 324 from fracing pressures. In some embodiments, the sleeve restraint 302 may serve primarily to protect the locking pins 324 from this pressure, or in other embodiments, the sleeve restraint 302 may serve primarily to restrain the bypass sleeve 304, allowing the locking pins 324 to be omitted (which, like other express opportunities for omissions identified herein, is not to suggest that other features may not also be omitted).

Figure 15:
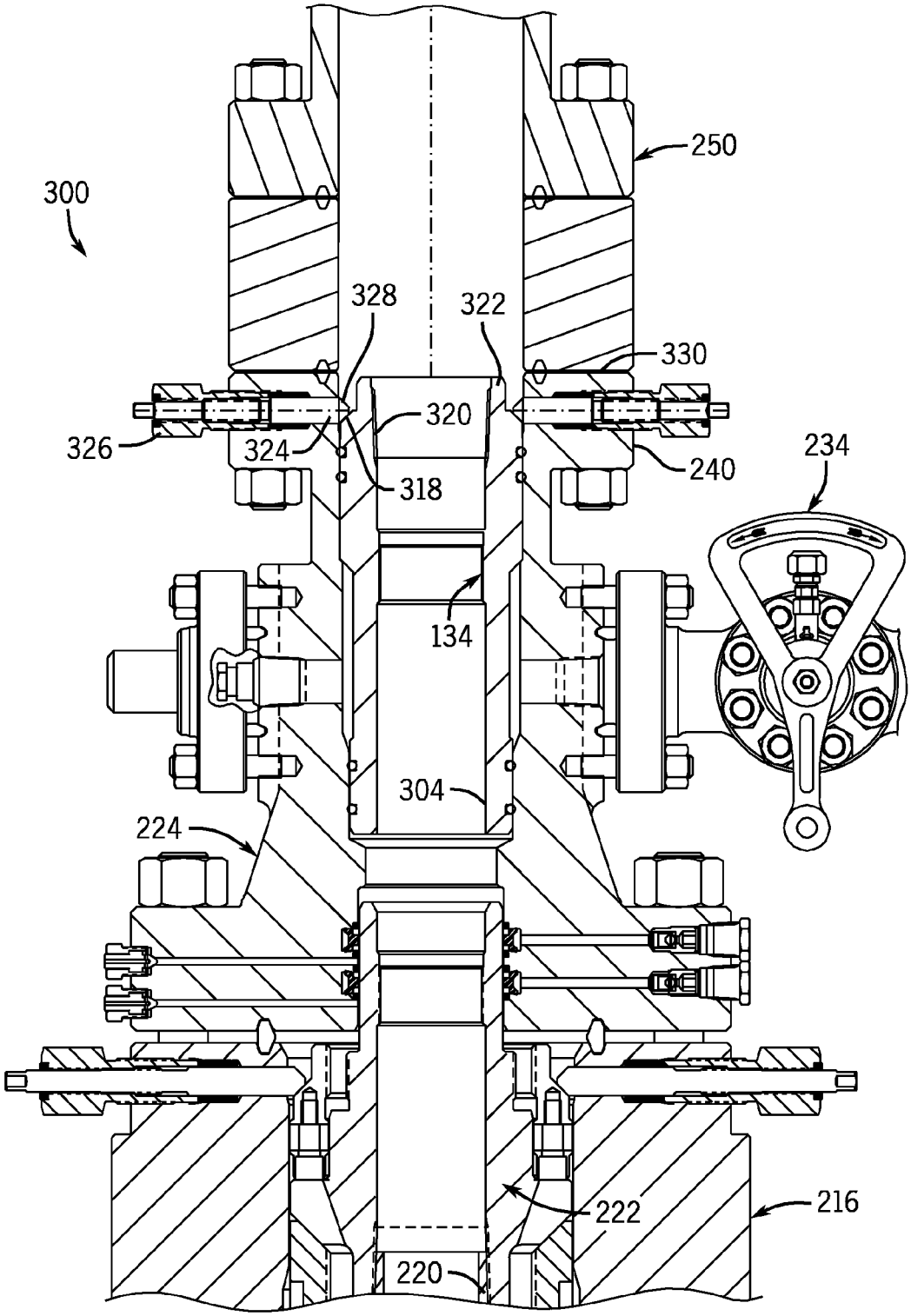
FIG. 15 illustrates a third example of a bypass sleeve and a wellhead assembly in accordance with an embodiment of the invention.

In some embodiments, the bypass sleeve 304 functions without the sleeve restraint 302, as illustrated by FIG. 15. In this embodiment, the adapter 248 is omitted, but in other embodiments, the adapter 248 may be included between the flange 240 and the blowout preventer 250. The illustrated bypass sleeve 304 does not extend above the top 330 of the tubing head 224, into the blowout preventer 250 or other components coupled to the flange 240, but in other embodiments, the sleeve 304 may extend above the flange 240.

Figure 16:
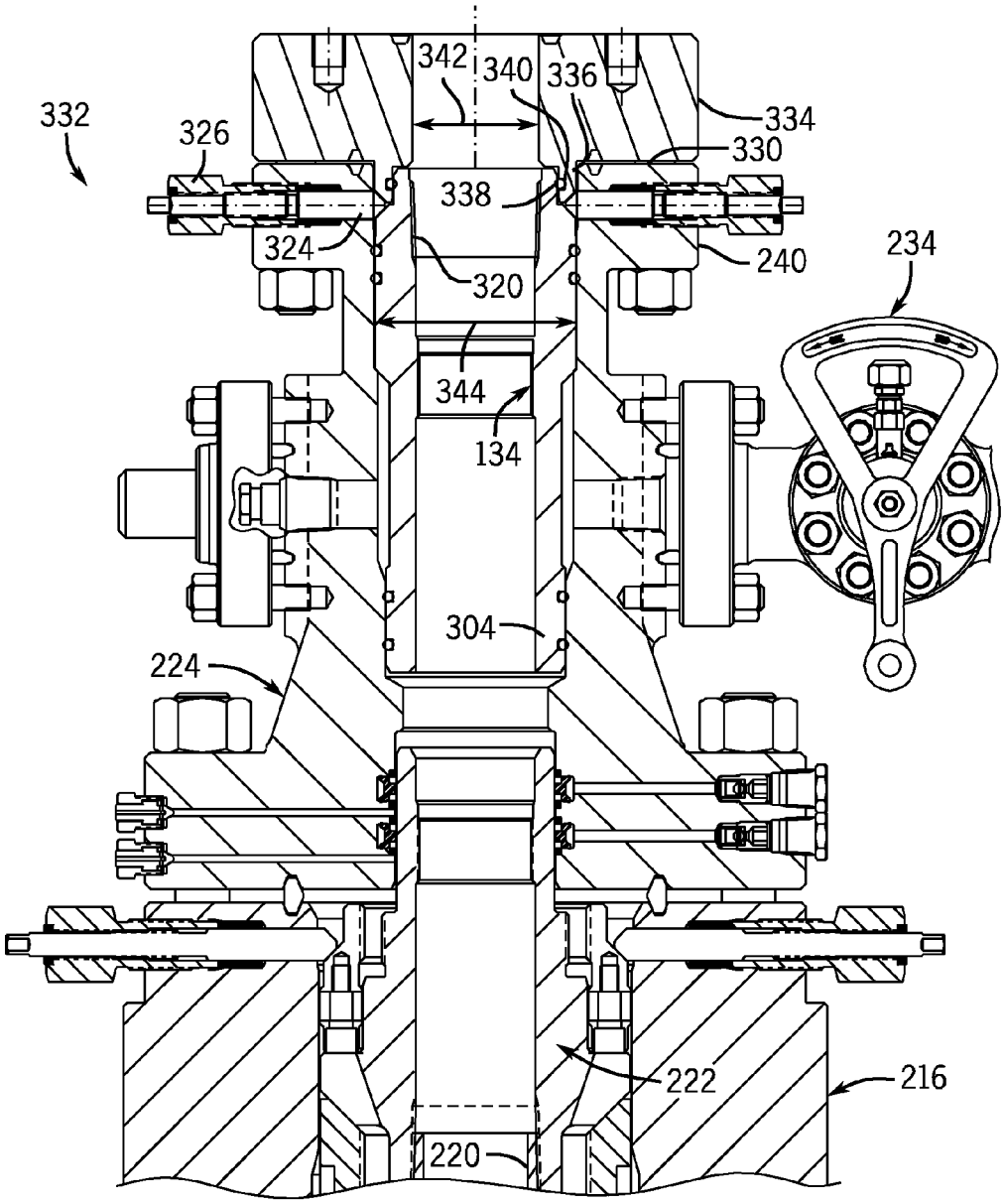
FIG. 16 illustrates the bypass sleeve of FIG. 15 installed in another example of a wellhead assembly in accordance with an embodiment of the invention.

FIG. 16 illustrates another embodiment in which the bypass sleeve 304 functions without the sleeve restraint 302. This embodiment includes the bypass sleeve 304 installed in another example of a wellhead assembly 332. The illustrated wellhead assembly 332 is generally similar to the wellhead assembly 300 described above except that the illustrated wellhead assembly 332 includes an adapter 334 with a flange 336 that seals against the bypass sleeve 304. The flange 336 extends below the top 330 of the tubing head 224 and includes a seal member 338 disposed in a groove 340. The illustrated seal member 338 and groove 340 are disposed in an inner surface of the flange 336 and are positioned to seal against the outer surface of the bypass sleeve 304.

The adapter 334 has an inner diameter 342 that is generally narrower than an outer diameter 344 of the bypass sleeve 304 such that the adapter 334 overlaps the bypass sleeve 304. Consequently, to install the bypass sleeve 304 in some embodiments, the adapter 334 is removed while the bypass sleeve 304 is installed in the wellhead assembly 332. For example, in some installation processes, the bypass sleeve 304 is installed through the previously-described adapter 248 and, then, the adapter 248 is replaced with the adapter 334 to provide added support and sealing during a fracing operation. After fracing the well, and sealing the bypass sleeve 304 with the previously-described pressure barrier 255, the adapter 334 may again be replaced with the adapter 248 to allow the bypass sleeve 304 to be withdrawn through a blowout preventer, christmas tree, or other equipment attached to the wellhead assembly 332.

Figure 17:
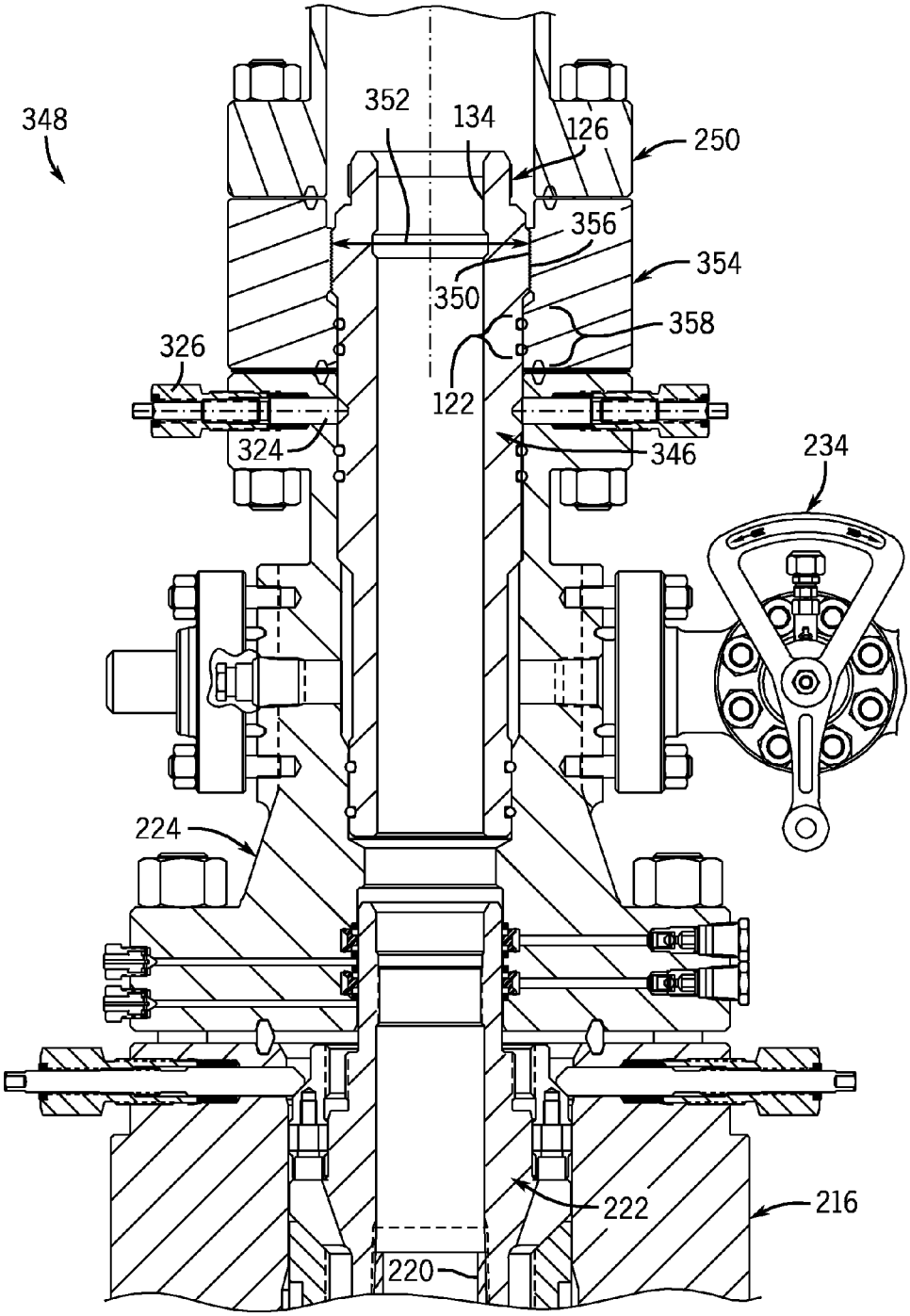
FIG. 17 illustrates a fourth example of a bypass sleeve installed in a wellhead assembly in accordance with an embodiment of the invention.

FIG. 17 illustrates another example of a bypass sleeve 346 installed in another embodiment of a wellhead assembly 348. Again, many of the features of these components 346 and 348 are similar to the features of components described above. Accordingly, the same reference numbers are used to indicate features that are generally similar to features that were described above with the same reference numbers.

The bypass sleeve 346 includes exterior threads 350 that are configured to secure the bypass sleeve 346 in the wellhead assembly 348. In this embodiment, the threads 350 have a wider outer diameter 352 than portions of the bypass sleeve 346 disposed above and below the threads 350. This is believed to facilitate moving the bypass sleeve 346 into and out of the wellhead assembly 348 without the threads 350 or complementary structures interfering with components disposed above or below the threads 350. In other embodiments, portions of the bypass sleeve 346 disposed above the threads 350 may be wider than the diameter of the threads 350.

The wellhead assembly 348 illustrated by FIG. 17 includes an adapter 354 configured to interface with the bypass sleeve 346. In this embodiment, the adapter 354 includes complimentary threads 356 that join to the threads 350. The adapter 354 also includes a lower portion 358 with a narrower diameter to provide a sealing surface for the upper seal assembly 122.

In operation, the bypass sleeve 346 is installed in the wellhead assembly 348 with a process similar to the process 274 described above with reference to FIG. 12. To install the bypass sleeve 346, the pressure barrier 255 is threaded to the pressure-barrier interface 134, and the tool 256 (shown above in FIG. 6, inter alia) is coupled to the tool interface 126. Then, the bypass sleeve 346 and the pressure-barrier interface 134 are lowered into the wellhead assembly 348 through the blowout preventer 250, and the tool 256 rotates the bypass sleeve 346 to engage the exterior threads 350 and the threads 356. In some embodiments, the tool interface 126 is threaded in the same direction (e.g., clockwise or counter clockwise) as the exterior threads 350, such that torque from tightening the bypass sleeve 346 against the adapter 354 also tends to tighten the tool 256 against the bypass sleeve 346.

A variety of techniques may be used to disengage the tool 256 without also disengaging the bypass sleeve 346 from the adapter 354. For example, the locking pins 324 may be temporarily or permanently engaged with the bypass sleeve 346 to impede the bypass sleeve 346 from rotating when the tool 256 unthreads. To this end, in some embodiments, the bypass sleeve 346 includes dimples in its outer surface near the pins 324 to provide an engagement surface for the pins 324 to apply a torque to the bypass sleeve 346, thereby tending to reduce undesired rotation of the bypass sleeve 346. A similar technique may be used when removing or installing the pressure barrier 255 (shown above in FIG. 6). In another example, the tool interface 126 is threaded in an opposite direction from the direction of the outer threads 350, and the tool 256 is coupled to the bypass sleeve 346 by both threads and a shear pin. In this embodiment, once the bypass sleeve 346 is engaged with the adapter 354, the torque counteracting further rotation of the bypass sleeve 346 shears the shear pin, and the tool 256 unthreads from the bypass sleeve 346 by continuing to rotate in the same direction without the shear pin preventing relative rotation of the tool 256 and the bypass sleeve 346.

Figure 18:
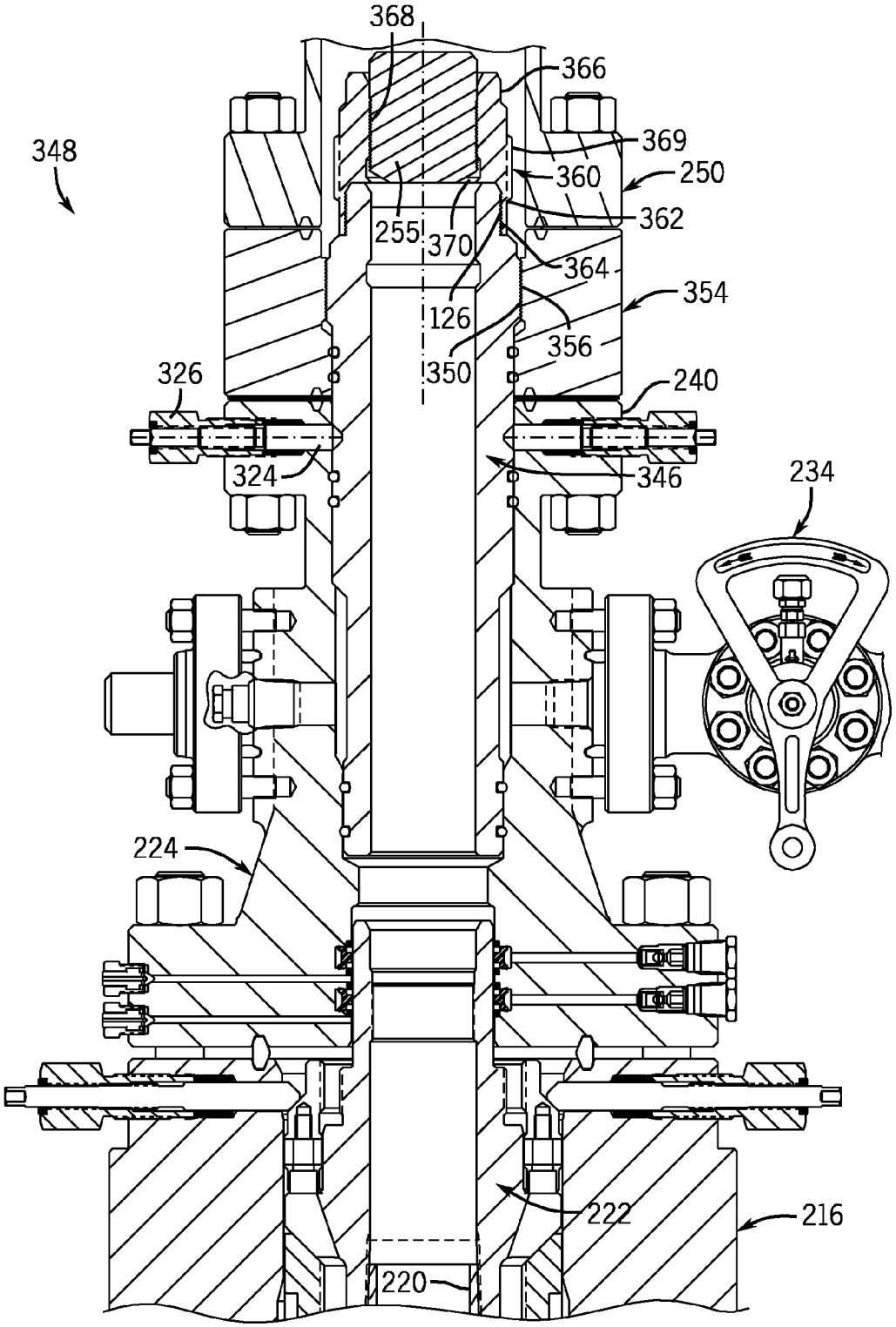
FIG. 18 illustrates a pressure barrier coupled to the bypass sleeve of FIG. 17 in accordance with an embodiment of the invention.

FIG. 18 illustrates an example of an intermediary member connecting the pressure barrier 255 to the bypass sleeve 346. The illustrated pressure-barrier adapter 360 includes a flange 362 having a threaded interface 364 that is complementary to the tool interface 126 on the exterior of the bypass sleeve 346. The pressure-barrier adapter 360 further includes a secondary tool interface 366 that is configured to interface with the tool 256 discussed above with reference to FIG. 6. The pressure-barrier adapter 360 also includes a pressure-barrier interface 368 that is configured to secure the pressure barrier 255 in an interior 370 of the pressure-barrier adapter 360.

In operation, the pressure-barrier adapter 360 may be installed and removed with the pressure barrier 255. The assembly of the bypass sleeve 346, the pressure-barrier adapter 360 and the pressure barrier 255 is introduced into the wellhead assembly 348 with a process similar to the processes of installing the bypass sleeve 346 described above with reference to FIG. 17. The pressure-barrier adapter 360 and pressure barrier 255 are threaded to the tool interface 126 of the bypass sleeve 346 outside of the wellhead assembly 348, and then, the resulting assembly is placed in the wellhead assembly 348 through the blowout preventer 250 by coupling the tool 256 to the tool interface 366 on the pressure-barrier adapter 360. In some embodiments, the threads on the secondary tool interface 366, the tool interface 126, and the exterior threads 350 are threaded in the same direction, such that installation of the bypass sleeve 346 via the pressure-barrier adapter 360 does not tend to unthread the pressure-barrier adapter 360 from the bypass sleeve 346. Then, before fracing the well, the pressure barrier 255 is removed from the wellhead assembly 348 with the pressure-barrier adapter 360. To remove these components, a different tool with a wider interior diameter and oppositely threaded flange is engaged with the tertiary tool interface 369. Then, the second tool rotates the pressure-barrier adapter 360 to disengage the pressure-barrier adapter 360 from the bypass sleeve 346. To prevent the bypass sleeve 346 from rotating when disengaging the pressure-barrier adapter 360, the locking pins 324 may be engaged against the side of the bypass sleeve 346. Because the tertiary tool interface 369 is oppositely threaded relative to the tool interface 126, tightening the second tool against the pressure-barrier adapter 360 tends to disengage the pressure-barrier adapter 360 from the bypass sleeve 346. Once the bypass sleeve 346 and intermediary member are separated, the pressure-barrier adapter 360 and the pressure barrier 255 are removed from the wellhead assembly 348. To reattach the pressure barrier 255 after fracing, the second tool is re-attached to the tertiary tool interface 369 and a shear pin is placed through these components to impede relative rotation. Then, the pressure-barrier adapter 360 and pressure barrier 255 are placed in the wellhead assembly 348 and threaded to the tool interface 126 until the shear pin is sheared and the second tool unthreads.

Figure 19:
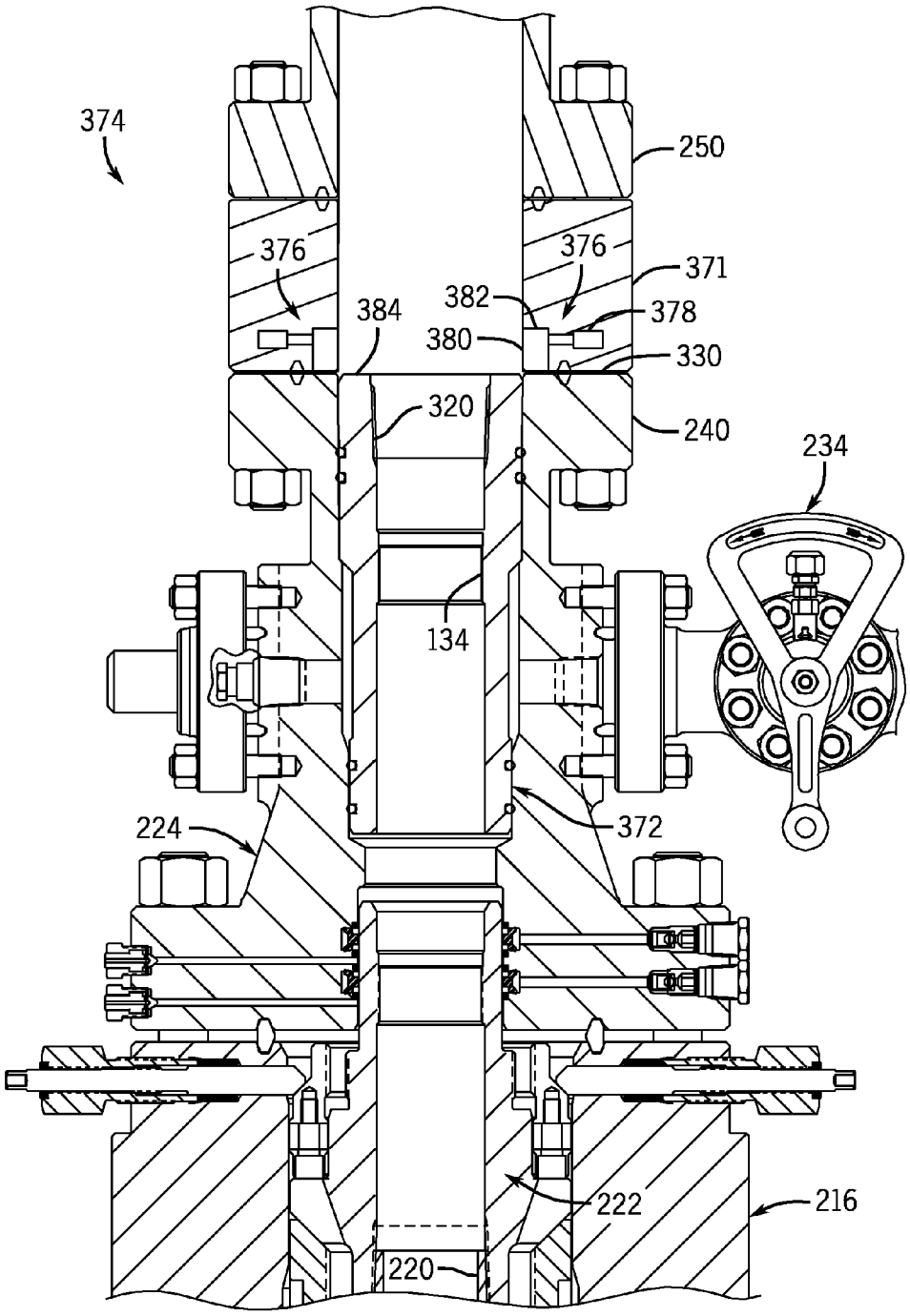
FIGS. 19 and 20 illustrate a fifth example of a bypass sleeve being installed in a wellhead assembly in accordance with an embodiment of the invention.
Figure 20:
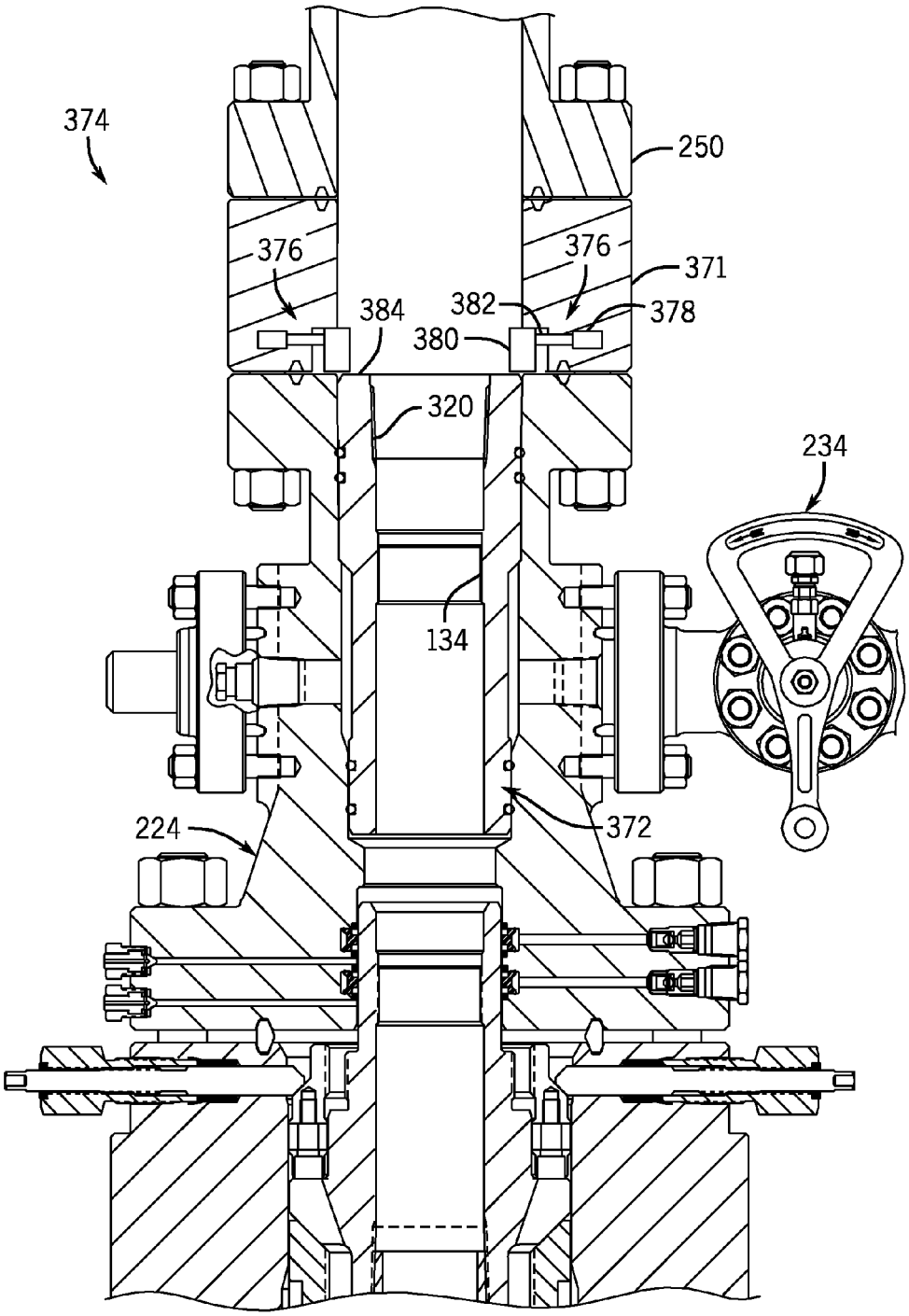

FIGS. 19-20 illustrate another example of an adapter 370, a bypass sleeve 372, and a wellhead assembly 374. In this embodiment, the adapter 370 includes sleeve restraints 376. The sleeve restraints 376 include an actuator 378 and a sliding member 380. In some embodiments, the actuator 378 is a hydraulic actuator, a spring-driven actuator, a linear motor, a screw drive, or a manually-operated actuator configured to displace the sliding member 380. The sliding member 380 is generally complementary to a cavity 382 in the adapter 370 such that the sliding member 380 can be retracted into the cavity 382 by the actuator 378, as illustrated by FIG. 19. The bypass sleeve 372 includes the features of the bypass sleeve 304 described above with reference to FIG. 15, except that in some embodiments its top edge 384 is generally flat near its outer diameter to interface with the sliding member 380.

The operation of the sleeve restraints 376 is illustrated by FIG. 20. The bypass sleeve 372 is positioned in the wellhead assembly 374 using the process for installing the previously-described bypass sleeve 304 in FIG. 15. Then, the sleeve restraints 376 lock the bypass sleeve 372 in place. The actuators 378 drive the sliding members 380 radially inward until the sliding members 380 overlap the top 384 of the bypass sleeve 372, thereby generally confining the bypass sleeve 372 in the wellhead assembly 374. To remove the bypass sleeve 372, the movement of the sliding members 380 is reversed with the actuator 378, and the sliding members 380 retract into the cavity 382 of the adapter 370.

Figure 21:
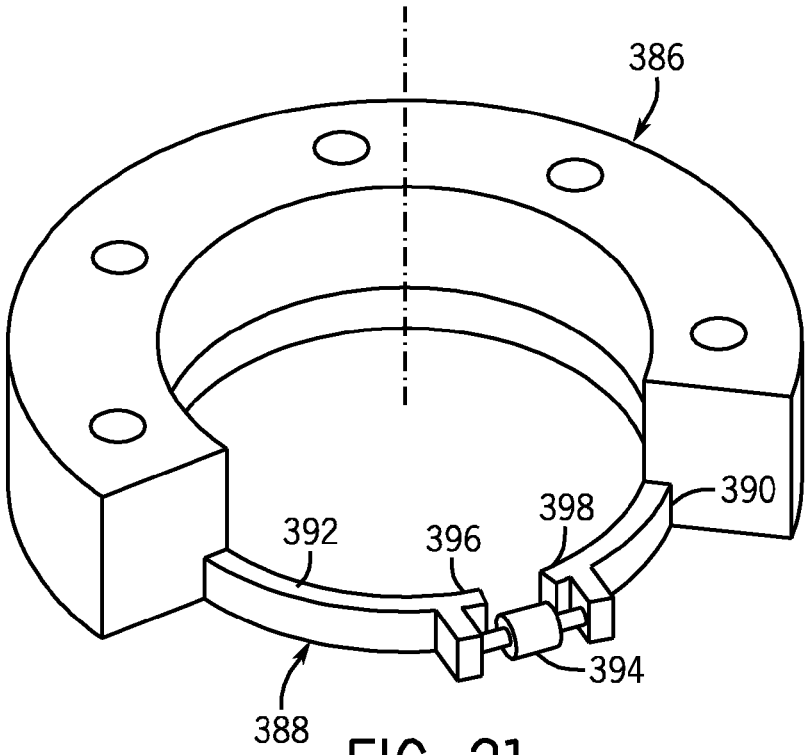
FIGS. 21 and 22 illustrate an example of a wellhead adapter in accordance with an embodiment of the invention.

FIG. 21 illustrates another example of an adapter 386 and sleeve restraints 388 that may be used in the wellhead assembly 374 with the bypass sleeve 372. The illustrated adapter 386 includes a generally annular cavity 390. The sleeve restraint 388 includes a lock ring 392 that generally has a C-shape and an actuator 394 connected to the ends 396 and 398 of the lock ring 392. The adapter 386 may be installed in the wellhead assembly 348 in place of the adapter 370.

Figure 22:
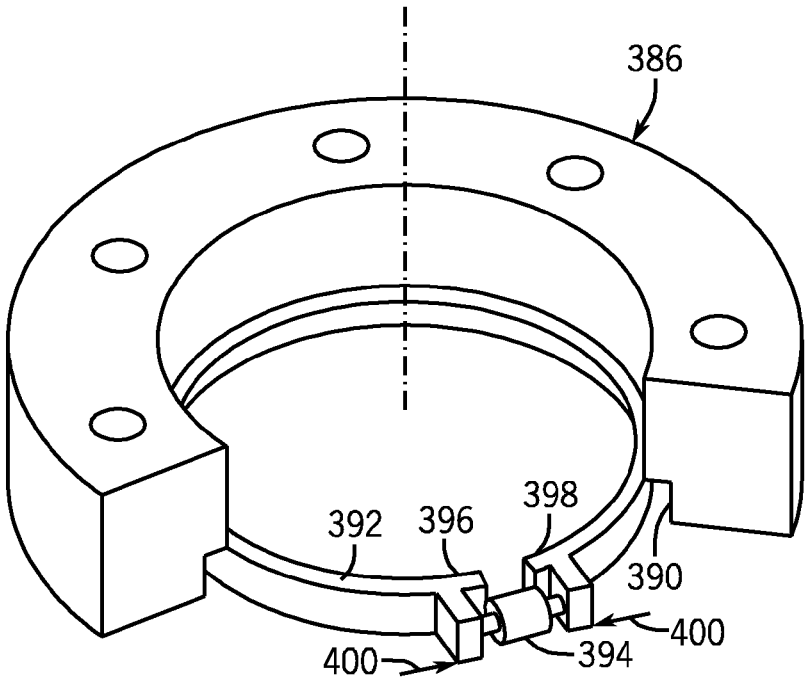

The operation of the adapter 386 is illustrated by FIG. 22. After the bypass sleeve 372 is positioned in the wellhead assembly 374 (as illustrated in FIGS. 19 and 20), the actuator 394 drives the ends 396 and 398 of the lock ring 392 toward each other, as illustrated by arrows 400 in FIG. 22, thereby contracting the lock ring 392 and drawing the lock ring 392 out of the cavity 390. In some embodiments, the contraction of the lock ring 392 causes the lock ring 392 to overlap the top 384 of the bypass sleeve 372, thereby restraining the bypass sleeve 372 in the wellhead assembly 374. To remove the bypass sleeve 372, the movement of the actuator 394 is reversed, and the ring 392 is expanded back into the cavity 390 of the adapter 386.

Figure 23:
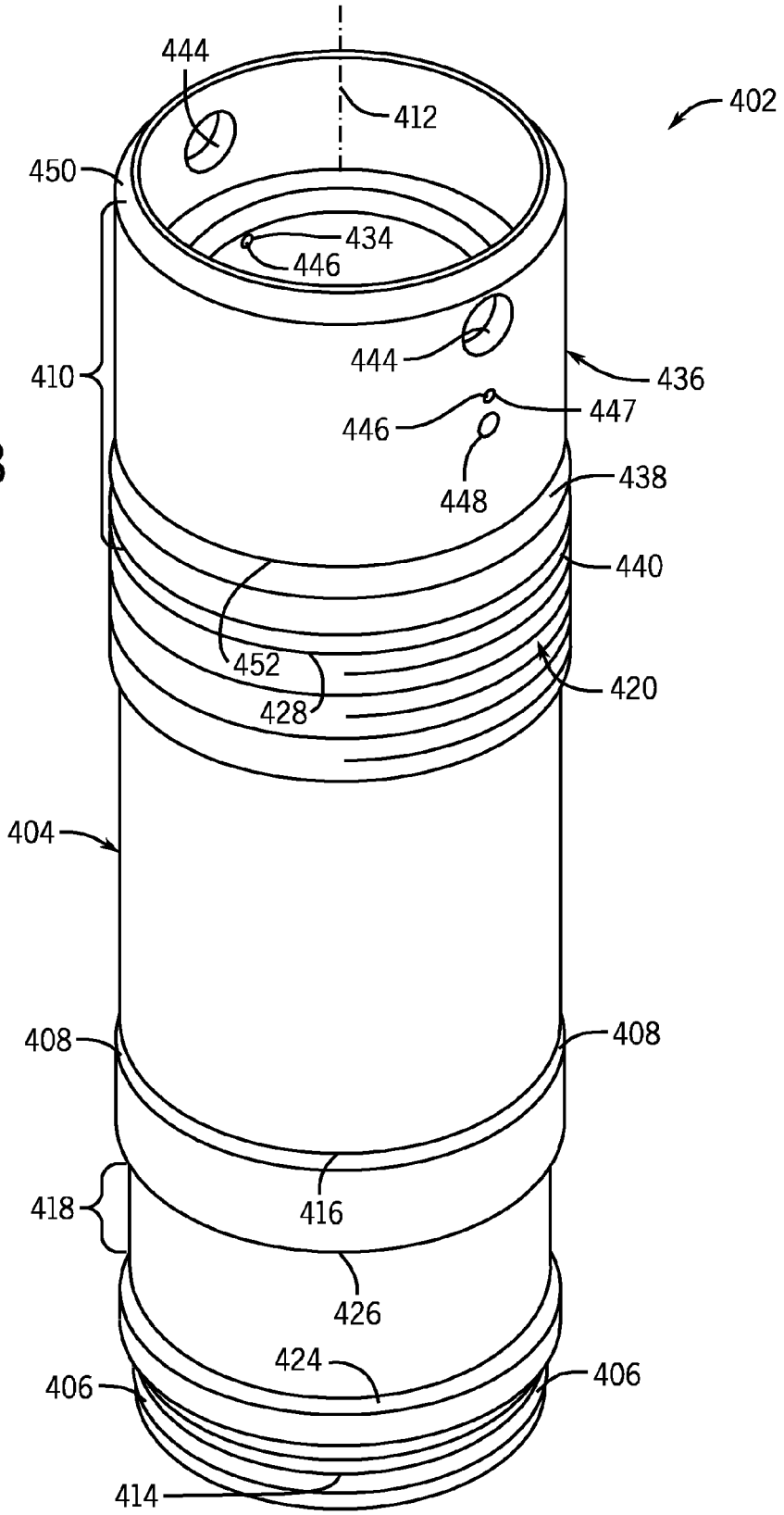
FIGS. 23-26 illustrate a sixth example of a bypass sleeve in accordance with an embodiment of the invention.
Figure 24:
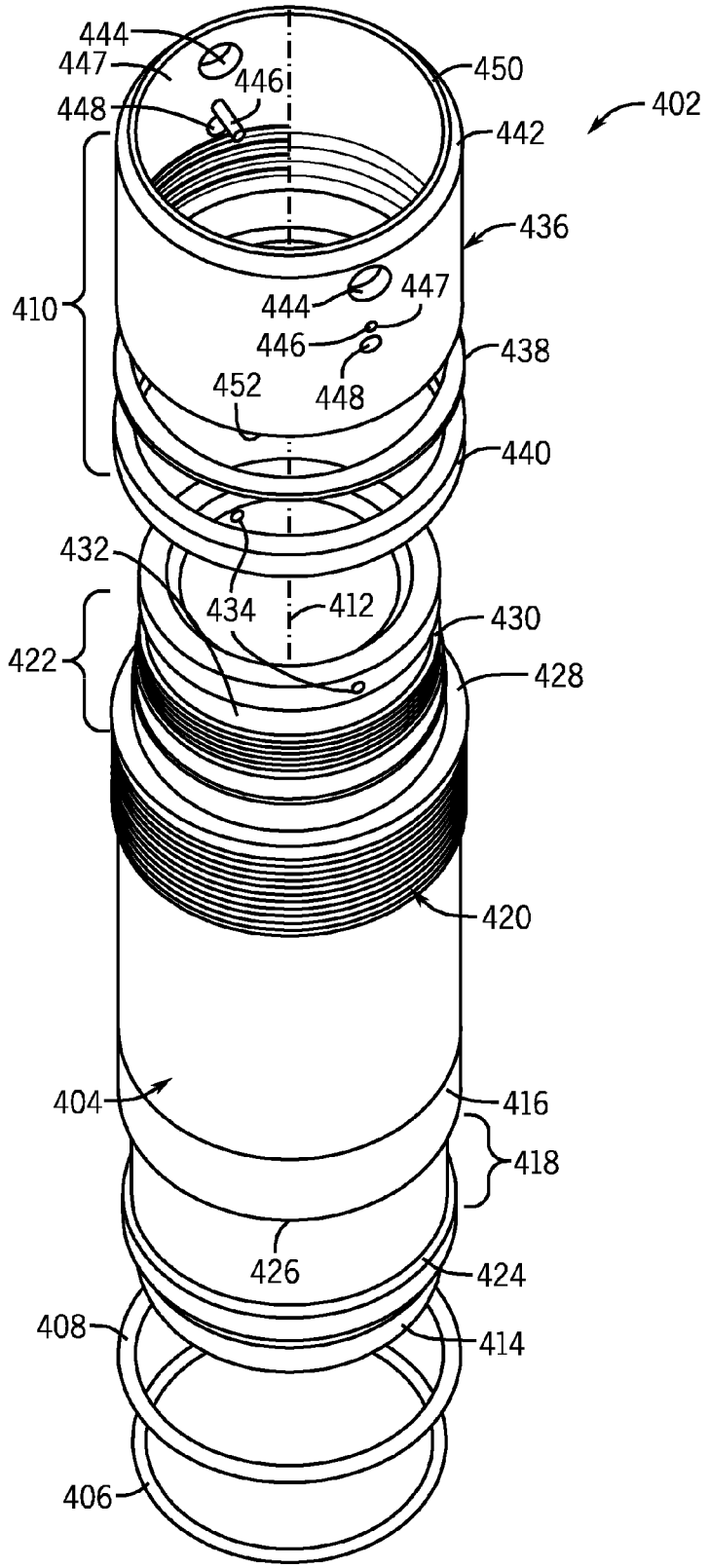

FIGS. 23-27 illustrate another example of a bypass sleeve 402. As illustrated by FIGS. 23 and 24, the bypass sleeve 402 includes a body 404, a lower seal member 406, an intermediate seal member 408, and an upper seal assembly 410.

As illustrated by FIG. 24, the illustrated body 404 is generally concentric about a central axis 412 and includes grooves 414 and 416, a channel 418, a sleeve restraint 420, and a compression-seal interface 422. The grooves 414 and 416 are shaped to receive the lower seal member 406 and the intermediate seal member 408, respectively. The channel 418 is bounded by shoulders 424 and 426. The illustrated sleeve restraint 420 includes external threads on the body 404, but in other embodiments, the sleeve restraint 420 may include other structures configured to restrain the sleeve in a wellhead assembly. In this embodiment, the threads extend further radially outward from the body 404 than the seal members 406 and 408, such that these seal members 406 and 408 tend to not interfere with threads that are sized to engage the sleeve restraint 420, i.e., the seal members 406 and 408 have a smaller diameter than the threads on the sleeve restraint 420. In some embodiments, the sleeve restraint 420 has a larger diameter than all, or substantially all, of the bypass sleeve 402 disposed below the sleeve restraint 420.

The compression seal interface 422 includes a shelf 428, threads 430, a groove 432, and shear-pin apertures 434. The shelf 428 may be generally orthogonal to the central axis 412, or it may be sloped or curved. In this embodiment, the threads 430 are threaded in the same direction as the threads on the sleeve restraint 420, but in other embodiments, they may be threaded in opposite directions. The groove 432 is generally concentric about the central axis 412 and is shaped to allow components of the upper seal assembly 410 to translate axially within the confines of an axial range and also rotate, as explained below. The shear-pin apertures 434 extend generally radially into the body 404 and are shaped to receive a portion of a subsequently described shear pin.

As illustrated by FIG. 24, the upper seal assembly 410 includes a bushing 436, a washer 438, and a compression-seal member 440. In this embodiment, the bushing 436 has a generally tubular shape and is generally concentric about the central axis 412. The bushing 436 may be made of steel or other appropriate materials. The illustrated bushing 436 includes a top chamfer 442, a tool interface 444, shear pins 446, shear-pin apertures 447, guide members 448, threads 450, and a bottom face 452. The illustrated tool interface 444 is formed from two generally-circular apertures through the bushing 436 that are disposed near the top of the bushing 436. In other embodiments, the tool interface 444 may have another shape, such as threads, slots, or structures shaped to interface with a lock ring.

In the illustrated embodiment, the shear pins 446 extended generally radially inward from the shear-pin apertures 447. The shear pins 446 may be made of metal, plastic, ceramic, or other appropriate materials. As explained below, the shear pins 446 shear when a torque above some threshold is applied to the bushing 436. Accordingly, the shape and material of the shear pins 446 may be selected with a desired torque threshold in mind. In some embodiments, the shear pins 446 are replaceable.

The illustrated guide members 448 extend generally radially inward into the bushing 436. In this embodiment, the guide members 448 are two generally right-circular-cylindrical members generally disposed 180 degrees apart, but in other embodiments, they may have other shapes or include a different number of structures. For example, in one embodiment, the guide members 448 are formed by a single rib extending generally radially inward and generally concentric about the central axis 412. The threads 450 are complementary to the threads 430 on the body 404. The bottom face 452 may be generally flat and generally orthogonal to the central axis 412.

The illustrated washer 438 is shaped to function as an interface between the bottom face 452 of the bushing 436 and the compression-seal member 440. Accordingly, in some embodiments, the washer 438 is made of metal or some other material selected to protect the compression-seal member 440 from sliding friction while transmitting an axial load from the bushing 436 to the compression-seal member 440. The bottom face of the washer 438 is generally flat and generally orthogonal to the central axis 412, but in other embodiments, it may be sloped or curved.

The illustrated compression-seal member 440 is a compressible material, such as an elastomer, that has a Poisson's ratio greater than 0, e.g., greater than 0.25, 0.35 or 0.4, such that an axial load causes the compression-seal member 440 to expand radially and bias against a wellhead assembly. The compression-seal member 440 may have a generally rectangular cross-section, or it may have an angled or curved face or faces shaped to enhance radial movement, e.g., a wedge shape.

Figure 25:
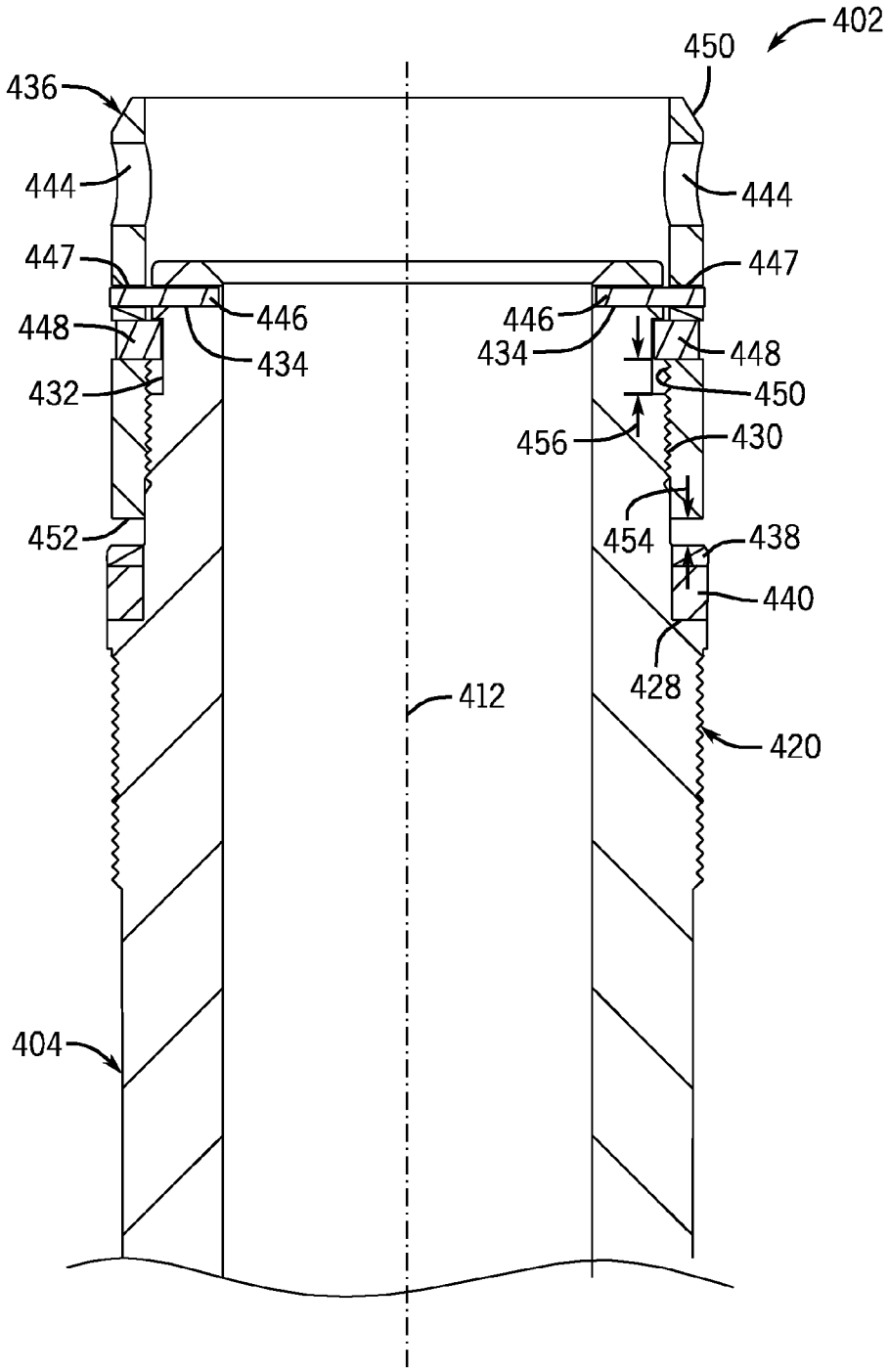
Figure 26:
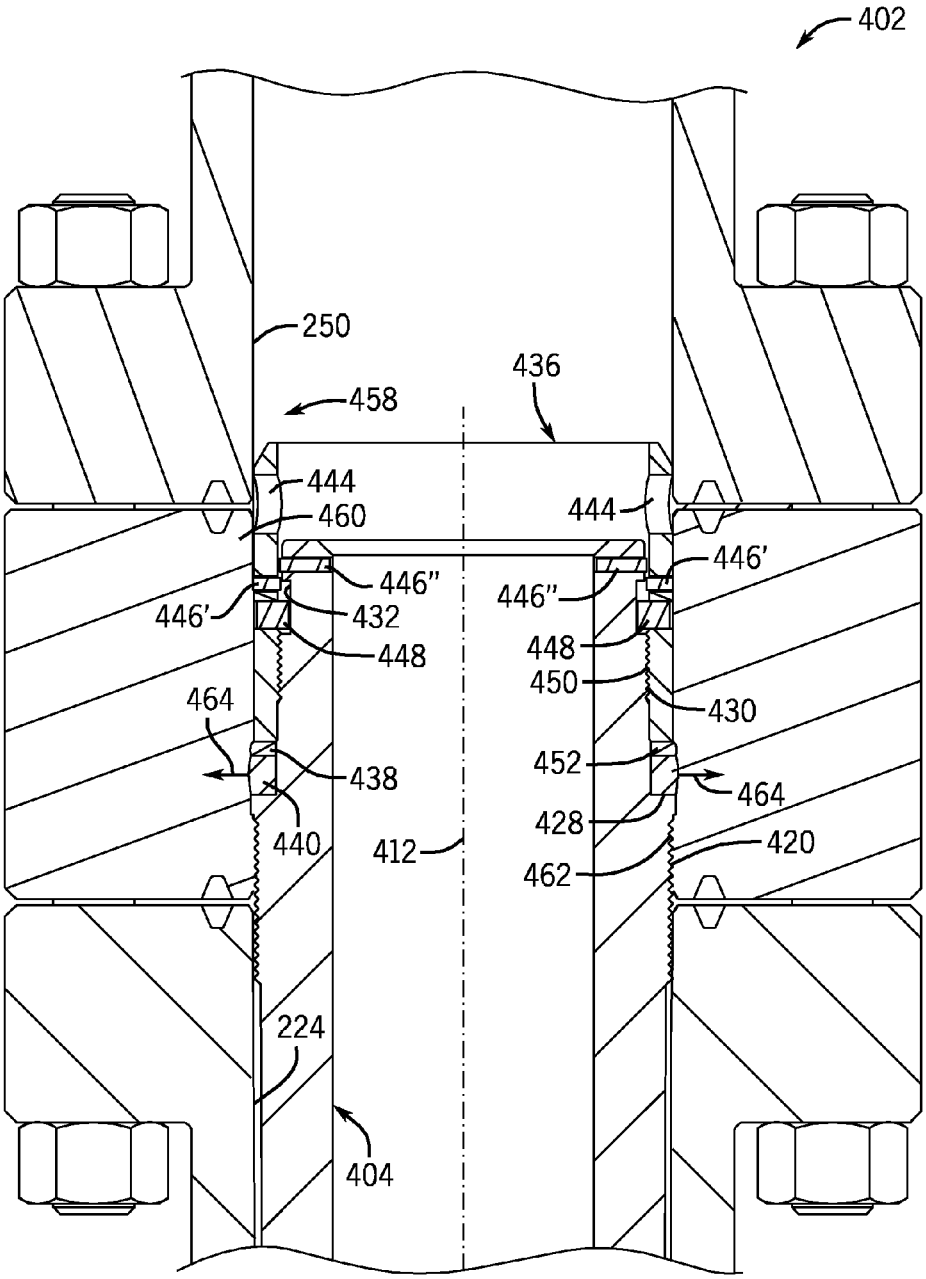

FIGS. 25 and 26 are cross-sectional views that illustrate the bypass sleeve 402 before and after installation, respectively. As illustrated by FIG. 25, before installation, the shear pins 446 cooperate with the threads 450 and 430 to couple the bushing 436 to the body 404, e.g., with generally zero degrees of freedom. The threads 430 and 450 tend to limit axial movement of the bushing 436 relative to the body 404, and the shear pins 446, extending through the shear-pin apertures 447 into the shear-pin apertures 434, generally tend to limit both relative rotation of the bushing 436 and the body 404 and axial movement. In this embodiment, there is a gap 454 between the bottom face 452 of the bushing 436 and the washer 438. In other embodiments, the gap 454 may be closed, and the bottom face 452 may contact the washer 438 without substantially biasing the compression-seal member 440 before installation. The guide members 448 extend into the groove 432 near a top portion of the groove 432, leaving a gap 456 that, in some embodiments, is larger than the gap 454.

FIG. 26 illustrates the bypass sleeve 402 installed in a wellhead assembly 458. The illustrated wellhead assembly 458 includes the blowout preventer 250, an adapter 460 and the tubing head 224. The illustrated adapter 460 includes threads 462 that are complementary to the threads 420 on the body 404.

In the illustrated embodiment, the bypass sleeve 402 is installed in the wellhead assembly 458 with a two-step process. First, the bypass sleeve 402 is threaded onto the adapter 460. To this end, a tool may couple to the tool interface 444 and lower the bypass sleeve 402 through the blowout preventer 250. (One example of a tool configured to interface with the bypass sleeve 402 is described below with reference to FIG. 29.) When the bypass sleeve 402 reaches the threads 462, the tool rotates the bypass sleeve 402 to engage the threads 420 with the threads 462. While engaging the threads 420 and 462, the shear pins 446 remain in an un-sheared state, as illustrated by FIG. 25. Torque applied by the tool to the bushing 436 is transferred to the body 404 through the shear pins 446, thereby causing the body 404 to rotate and couple to the wellhead assembly 458.

When the threads 420 and 462 are substantially or fully engaged, the tubing head 224 impedes further axial movement of the body 404, thereby counteracting the tendency of the threads 420 and 462 to axially move the body 404 and creating a torque that counteracts the rotation of the tool. Despite this counter-rotation torque, the tool continues to rotate, elevating shear in the shear pins 446 until the shear pins 446 fracture into separate pieces 446' and 446", as illustrated by FIG. 26.

When the shear pins 446 fracture, in this embodiment, they generally cease transmitting torque between the body 404 and the bushing 436, which allows the bushing 436 to rotate relative to the body 404. At this stage, the bushing 436 may be characterized as having one or two degrees of freedom relative to the body 404, depending on whether the threads 430 and 450 are engaged. Rotation and downward movement of the bushing 436 engages (or further engages) the threads 430 and 450, and the bushing 436 translates axially toward the compression-seal members 440, closing the gap 454. Axial movement of the bushing 436 is relatively unimpeded by the guide members 448 within a range defined by the grooves 432. After sufficient axial movement, the bottom face 452 of the bushing 436 biases, e.g., compresses, the washer 438 against the compression-seal member 440. The shoulder 428 counteracts this force, axially biasing the compression-seal member 440. As the compression-seal member 440 is biased, it expands radially outward, as illustrated by arrows 464, and compresses against the sidewalls of the adapter 460, sealing the upper portion of the adapter 460.

The bypass sleeve 402 may also be removed through the blowout preventer 250 (or other equipment coupled to the tubing head 224). To remove the bypass sleeve 402, the tool is lowered through the blowout preventer 250 and engaged to the tool interface 444. Then, the tool rotates the bushing 436 in the opposite direction from the direction it was rotated during installation. As of the bushing 436 rotates, the threads 430 and 450 cause the bushing 436 to translate axially upward. Upward axial movement of the bushing 436, however, is constrained by the guide member 448 and the groove 432. When the guide member 448 reach the top of the groove 432, axial movement of the bushing 436 relative to the body 404 is impeded by contact between the guide member 448 and the top of the groove 432, and the body 404 begins to rotate with the bushing 436. This rotation of the body 404 disengages the threads 420 and 462, and the bypass sleeve 402 is freed from the adapter 460, at which point the tool extracts the bypass sleeve 402 through the blowout preventer 250.

Figure 27:
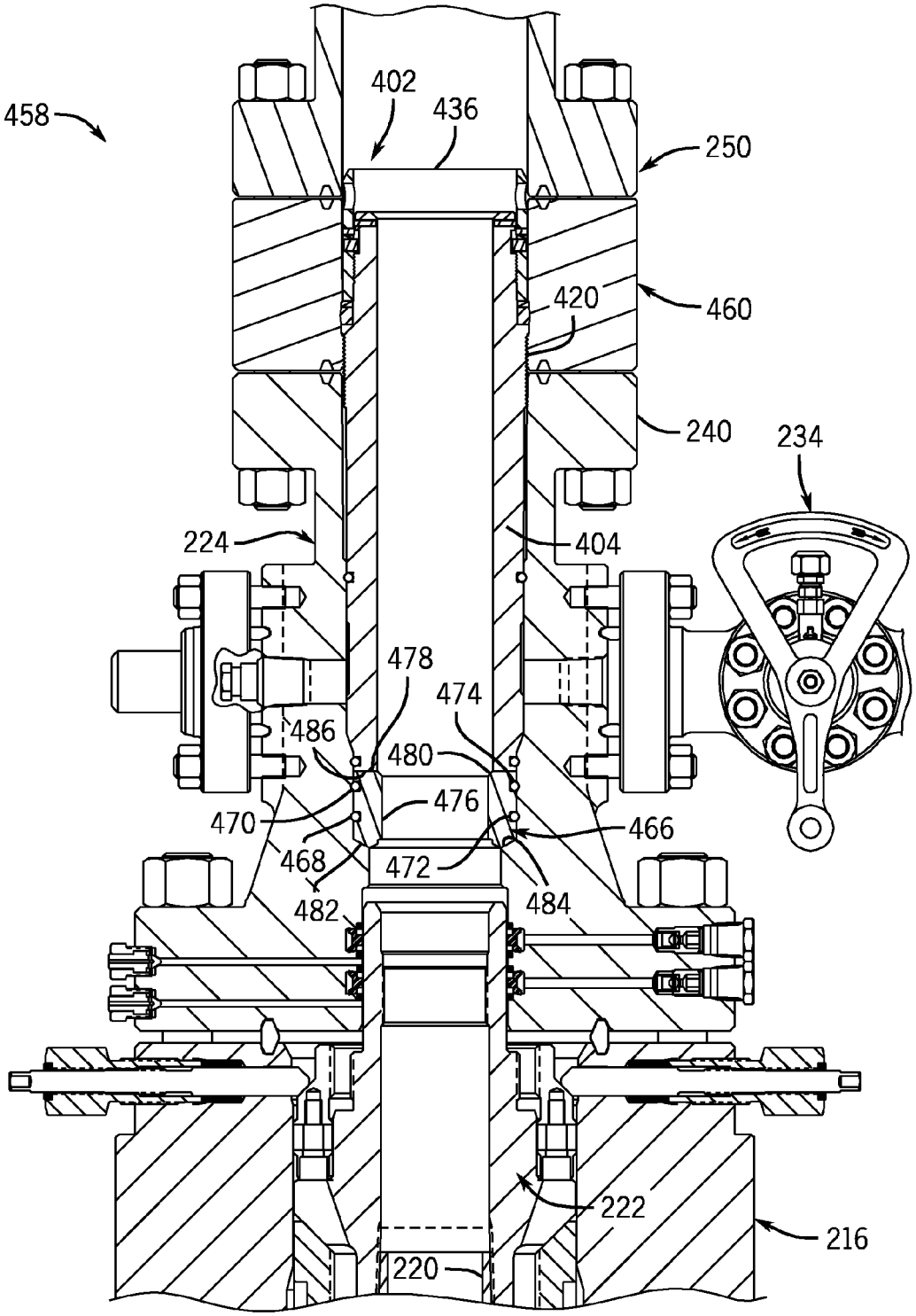
FIG. 27 illustrates an example of a pressure-barrier adapter in accordance with an embodiment of the invention.

FIG. 27 illustrates additional details of the wellhead assembly 458. As illustrated, the bypass sleeve 402 is installed in the wellhead assembly 458 along with a pressure-barrier adapter 466. The illustrated pressure-barrier adapter 466 is a generally tubular member that includes seals 468 and 470 disposed in grooves 472 and 474, and a pressure-barrier interface 476. The illustrated pressure-barrier interface 476 is formed by threads in the interior of the pressure-barrier adapter 466. In some embodiments, the threads on the pressure-barrier interface 476 are threaded in an opposite direction from the threads 420 on the bypass sleeve 402, or in other embodiments, they are threaded in the same direction. The pressure-barrier interface 476 is configured to secure a pressure barrier to the pressure-barrier adapter 466.

The pressure-barrier adapter 466 also includes a top face 478, a top chamfer 480, and a bottom chamfer 482. The pressure-barrier adapter 466 is supported by the bottom chamfer 482 resting on a shoulder 484 of the tubing head 224. In some embodiments, the pressure-barrier adapter 466 is biased against the shoulder 484 by a bottom face 486 of the bypass sleeve 402 contacting the top face 478.

The pressure-barrier adapter 466 may be installed separately, before the bypass sleeve 402, or it may be installed generally at the same time along with the bypass sleeve 402. To install these components together, a portion of the tool may extend through the bypass sleeve 402 and thread to the pressure-barrier interface 476, as described below with reference to FIG. 29. In some embodiments, the threads on the pressure-barrier interface 476 are opposite the threads 420 on the bypass sleeve 402, and as a result, in these embodiments, threading the bypass sleeve 402 to the adapter 460 with the tool described below also tends to unthread the tool from the pressure-barrier adapter 466.

In other embodiments, the bypass sleeve 402 may be configured to secure the pressure barrier. In some of these embodiments, the bypass sleeve 402 includes the pressure-barrier interface 134 described above with reference to FIG. 2.

Figure 28:
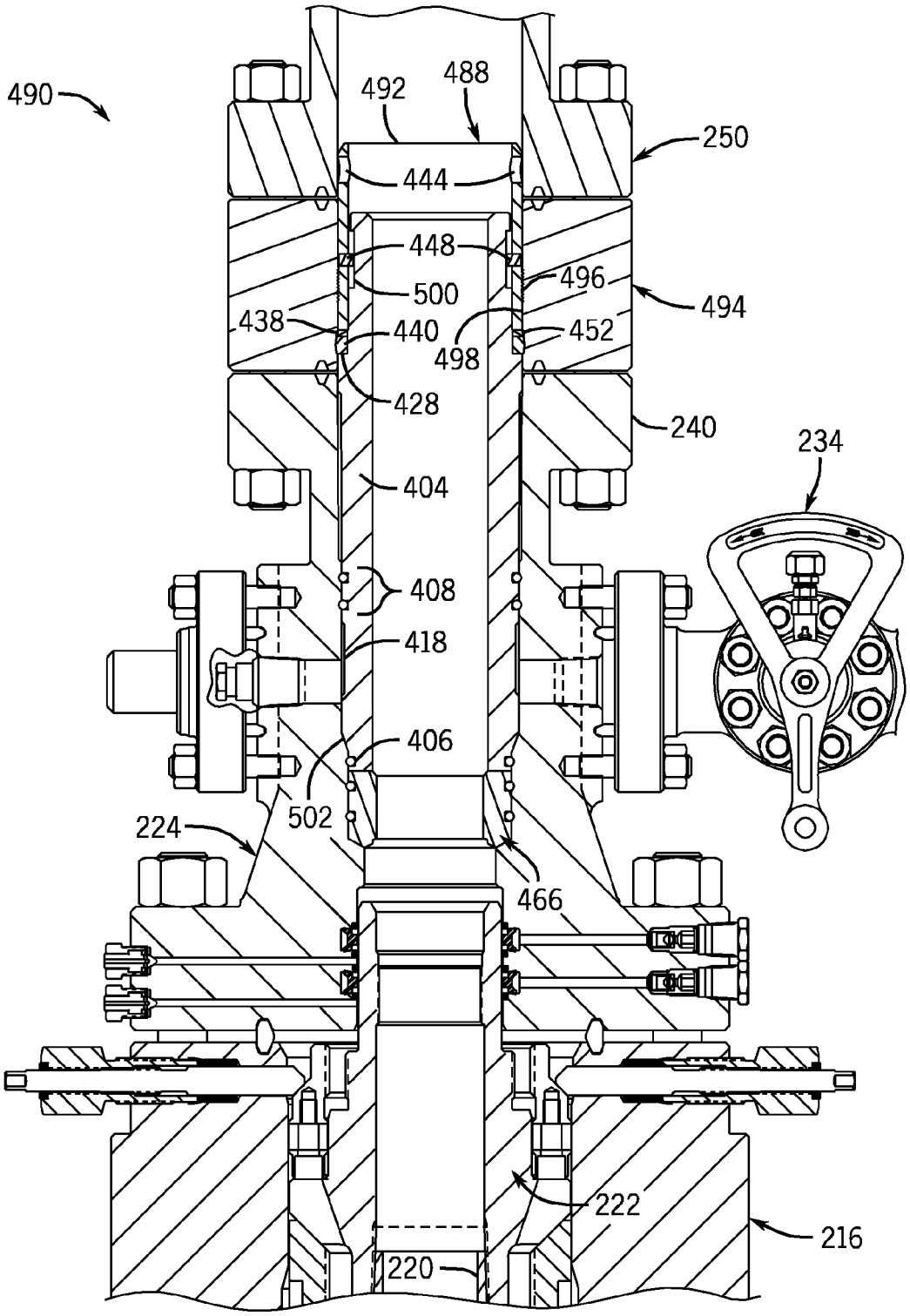
FIG. 28 illustrates a seventh example of a bypass sleeve in accordance with an embodiment of the invention.

FIG. 28 illustrates another example of a bypass sleeve 488 and a wellhead assembly 490. In this embodiment, a bushing 492 is threaded to (or is otherwise connected to) an adapter 494. The illustrated bushing 492 includes threads 496 that are complementary to threads 498 on the adapter 494. To facilitate relative axial translation of these components 492 and 494 as they are coupled, the bushing 492 also includes a generally annular groove 500 that is longer than the groove 432 described above.

To install the bypass sleeve 488, the bypass sleeve 488 is connected to a tool by the bushing 492 and lowered through the blowout preventer 250. In this embodiment, the bushing 492 carries the weight of the rest of the bypass sleeve 488 during an initial portion of installation. To carry this weight, the guide members 448 slide to the top of the groove 500, at which point the body 404 hangs from the bushing 492. The bypass sleeve 488 is lowered until the body 404 rests on the adapter 466 or some other portion of the tubing head 224, such as the shoulder 502. In other embodiments, the body 404 is not supported by the tubing head 224 or the adapter 466 until the bushing 492 is partially threaded to the adapter 494. The bushing 492 is rotated by the tool to engage the threads 498 and 496. As the bushing 492 threads to the adapter 494, the bushing 492 translates axially relative to the body 404, and the guide members 448 translate axially through the grooves 500 as they rotate with the bushing 492. The bushing 492 continues to thread to the adapter 494 until the bottom face of the bushing 492 compresses the washer 438 against the compression-seal member 440. As with the previous embodiment, the bushing 492 compresses the compression-seal member 440 against the shoulder 428, and the compression-seal member 440 expands radially, sealing against the side walls of the adapter 494.

To remove the bypass sleeve 488, the tool is reattached to the bushing 492, and the bushing 492 is rotated in the opposite direction, un-threading the threads 498 and 496. As the bushing 492 un-threads from the adapter 494, the guide members 448 both rotate and translate axially upward through the groove 500. Before the guide members 448 reach the top of the groove 500, the threads 496 and 498 disengage, at which point the tool lifts the bypass sleeve 488 by the bushing 492. As the bypass sleeve 448 is extracted through the blowout preventer 250, the guide members 448 rise to the top of the groove 500, and the body 404 hangs from the bushing 492.

In other embodiments, the threads 498 may be disposed on the tubing head 224, and the bypass sleeve 488 may be supported by the tubing head 224, without the adapter 494. Or, the bypass sleeve 488 may be supported by some other component, such as the blowout preventer, a frac tree, or a christmas tree. In some embodiments, the positions of the groove 500 and the guide member 448 may be reversed, with the groove 500 on an inner diameter of the bushing 492 and the guide member 448 extending generally radially outward from the body 404.

Figure 29:
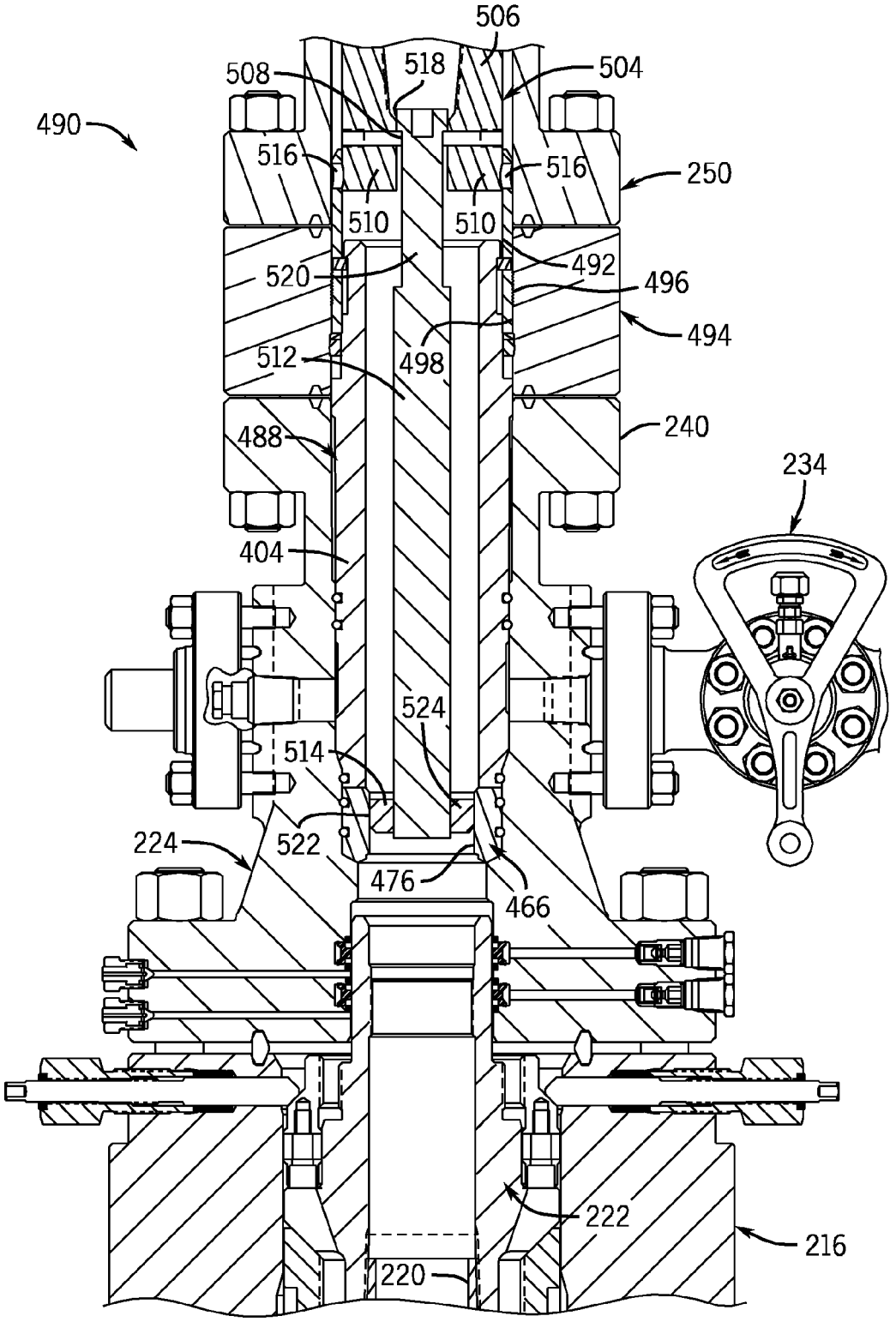
FIG. 29 illustrates the installation of the bypass sleeve of FIG. 28 and the pressure-barrier adapter of FIG. 27.

FIG. 29 illustrates an example of a tool 504 configured to install the bypass sleeve 488 and the adapter 466 at generally the same time. The illustrated tool 504 includes a shaft 506, a guide aperture 508, bushing interfaces 510, a sliding member 512, and an adapter interface 514.

The illustrated shaft 506 is configured to extend through the blowout preventer 250 and to support and rotate the bushing interfaces 510, the sliding member 512, and the adapter interface 514. The guide aperture 508 is generally complementary to the horizontal cross-section of the sliding member 512 and, in some embodiments, is shaped to allow the sliding member 512 to translate axially relative to the shaft 506, but not rotate relative to the shaft 506. For example, both the guide aperture 508 and the sliding member 512 may have a generally rectangular shape or some other non-circular shape. The sliding member 512 may be characterized as having generally one degree of freedom relative to the shaft 506. The illustrated bushing interfaces 510 include radially-distal members 516 that are configured to selectively engage the tool interface 444 of the bushing 492. The sliding member 512 includes a flange 518, which impedes the sliding member 512 from sliding through the guide aperture 508, and an upper portion 520 that is shaped to slide through the guide aperture 508 and transmit torque from the shaft 506.

In this embodiment, the lower portion of the sliding member 512 couples to the adapter 466 through threads 522. The threads 522 are disposed on a generally circular member 524 coupled to the sliding member 512 such that the circular member 524 rotates with the sliding member 512, e.g., with zero degrees of relative freedom. In some embodiments, the threads 522 are opposite (e.g., threaded in an opposite direction relative to) the threads 496 on the bushing 492. As a result, as the bushing 492 is threaded to the adapter 494, the adapter interface 514 is generally simultaneously unthreaded from the adapter 466. The rotation of the shaft 506 is transmitted to the sliding member 512 through the guide aperture 508, and as the adapter interface 514 unthreads from the adapter 466, the sliding member 512 slides generally axially upward through the guide aperture 508.

Figure 30:
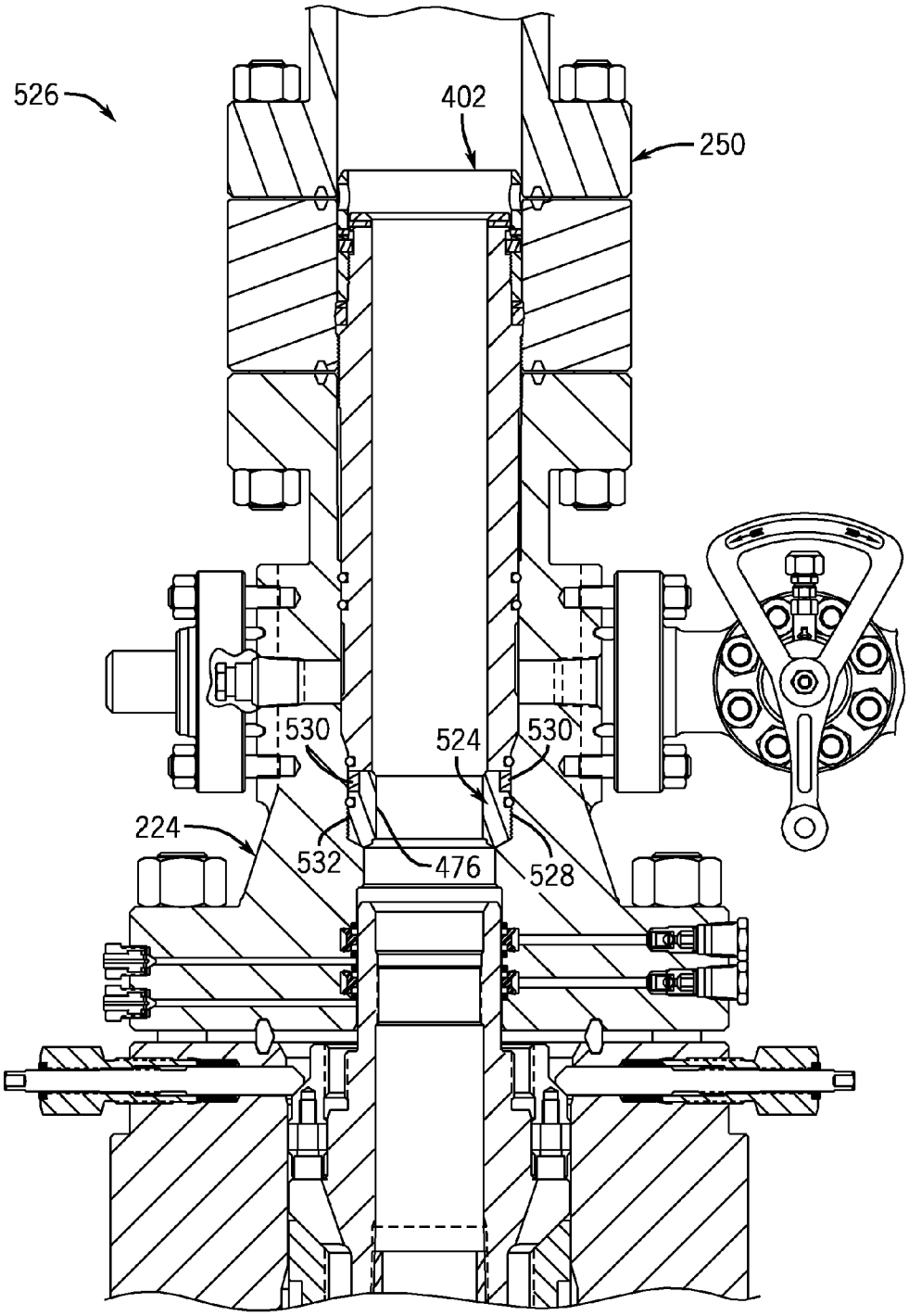
FIG. 30 illustrates a second example of a pressure-barrier adapter in accordance with an embodiment of the invention.

FIG. 30 illustrates another example of a pressure-barrier adapter 524 and a wellhead assembly 526. In this embodiment, the pressure-barrier adapter 524 includes a tubing-head interface 528 and a tool interface 530, and the wellhead assembly 526 includes an interface 532 that is configured to couple to the pressure-barrier adapter 524 through the tubing-head interface 528. The illustrated interfaces 532 and 528 are generally complementary threads, but in other embodiments, they may include other structures configured to secure the adapter 524 to the wellhead assembly 526, such as the lock ring 104 and lock-ring receptacle 252 described above with reference to FIGS. 2 and 4. The illustrated tool interface 530 includes notches in the upper outer diameter of the pressure-barrier adapter 524.

The pressure-barrier adapter 524 may be installed in the wellhead assembly 526 before the bypass sleeve 402 (or one of the other bypass sleeves described herein). To install the pressure-barrier adapter 524, a pressure barrier (such as the pressure barrier 255 described above with reference to FIG. 5) is coupled to the pressure-barrier interface 476, and the pressure-barrier adapter 524 is coupled to a tool with the tool interface 530. The pressure-barrier adapter 524 is then lowered through the blowout preventer 250 by the tool and threaded or otherwise coupled to the tubing head 224. After installing the pressure-barrier adapter 524, the bypass sleeve 402 (or some other bypass sleeve, such as one of the other bypass sleeves described above) is installed, and the fracing process 274 described above with reference to FIG. 12 may be performed.

Figure 31:
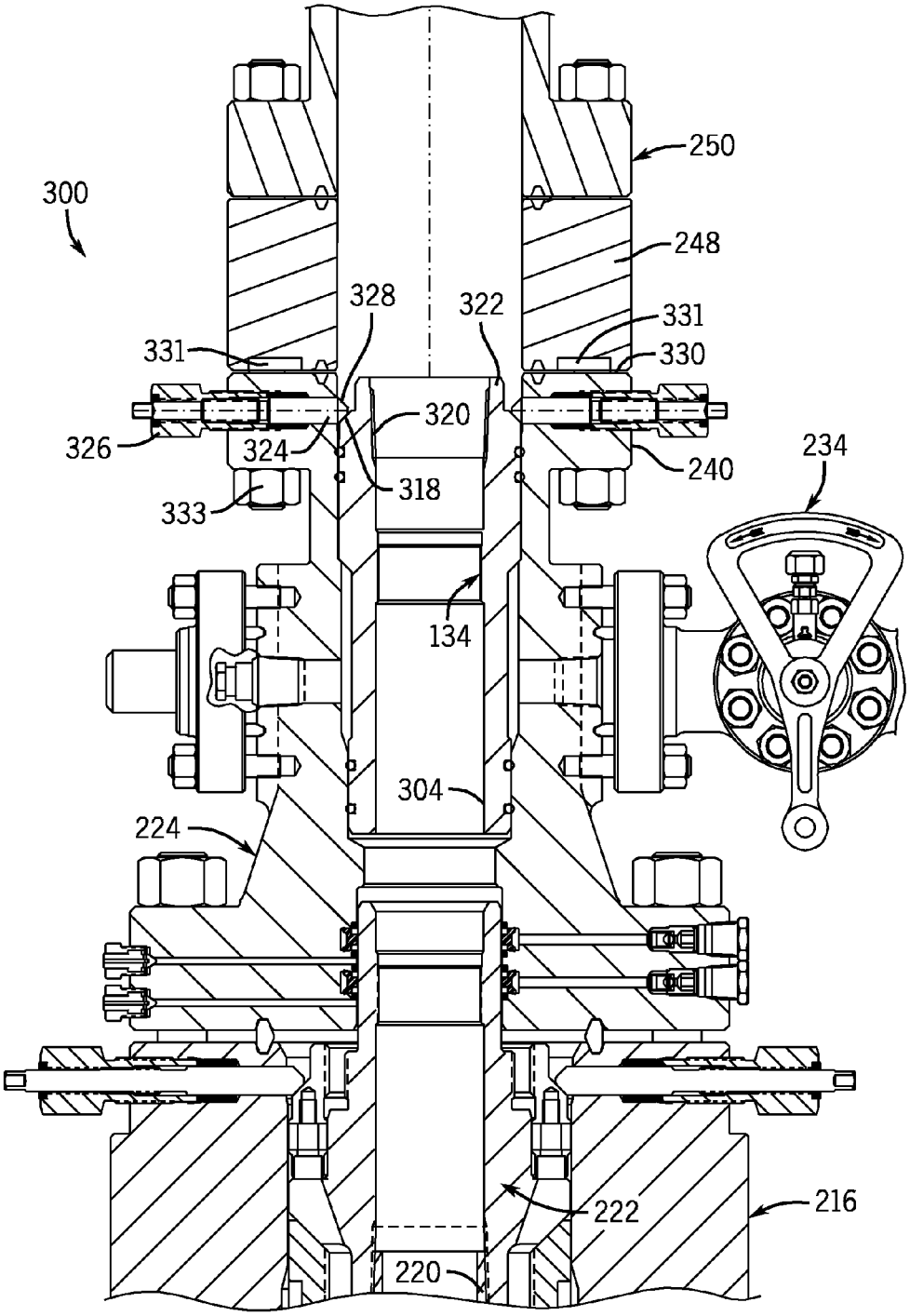
FIG. 31 illustrates another example of a bypass sleeve and a wellhead assembly in accordance with an embodiment of the invention.

FIG. 31 illustrates another embodiment of the present invention. The illustrated assembly is similar to that which is illustrated in FIG. 15. To manage pressure encountered during fracturing, the illustrated adapter 248 includes an annular recessed portion 331. The recessed portion 331 mitigates the occurrence of bending stresses in the adapter 248 and assembly. In the illustrated embodiment, the annular recessed portion 331 is disposed in a bottom surface of the adapter 248. However, in certain embodiments, the annular recessed portion 331 may be disposed in a top surface of the tubing spool 224. In some embodiments, the recessed portion 331 may be machined directly into a lower flange of equipment, such as a BOP or a frac tree, that can be directly mounted to the tubing spool 224. Advantageously, the bolts 333 may be formed of low-strength GR-B7M studs with 80 ksi yield-strength, or GR-B high-strength GR-B7 bolts, or L7 105 ksi yield-strength bolts.

Figure 32:
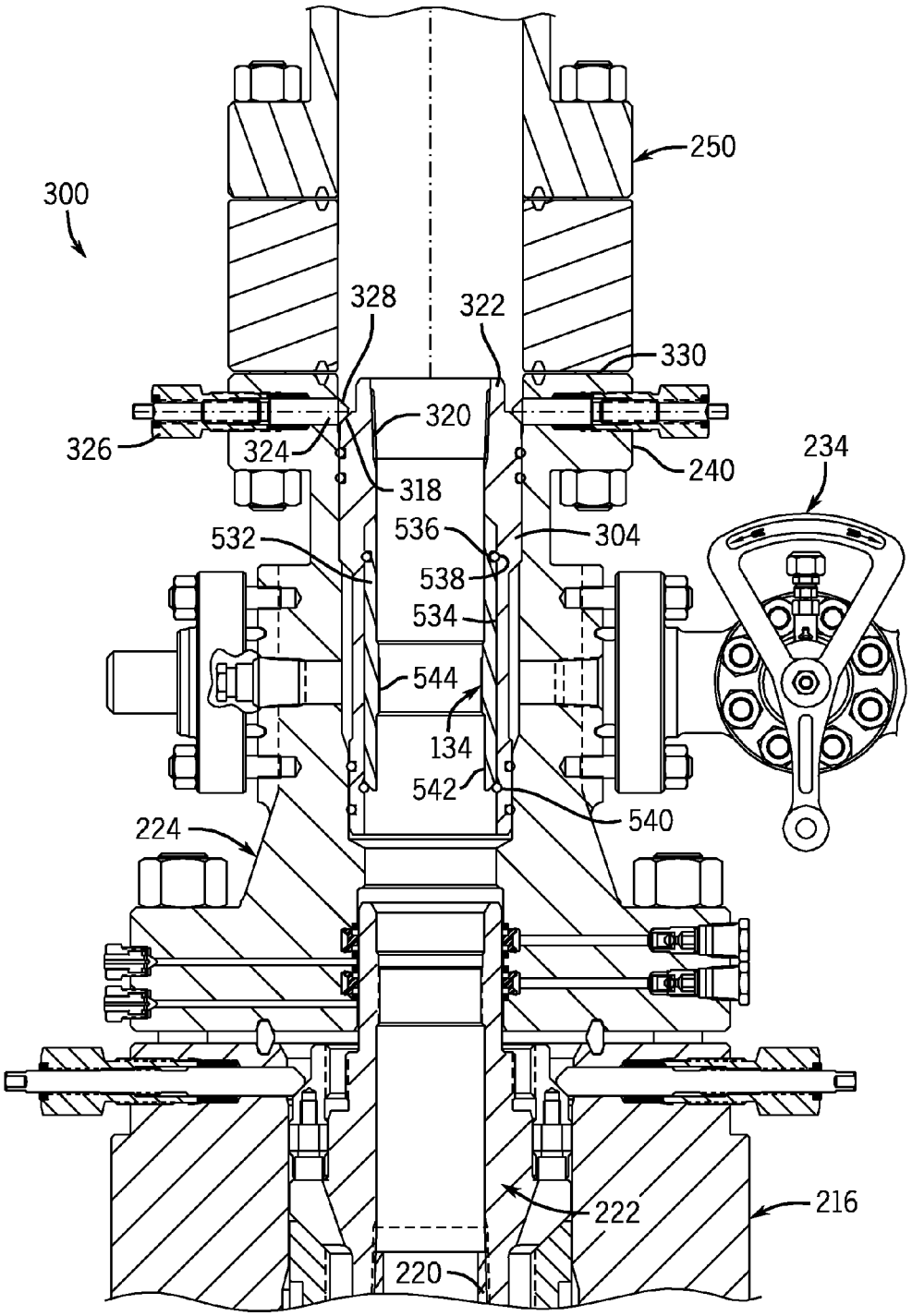
FIG. 32 illustrates an example of a bypass sleeve, a removable bushing, and a wellhead assembly in accordance with an embodiment of the invention.

FIG. 32 illustrates another embodiment of the present invention. The illustrated assembly is again similar to that which is illustrated in FIG. 15. However, in the illustrated embodiment, the bypass sleeve 304 is associated with a removable bushing 532. The removable bushing 532 may be removable from the bypass sleeve 304 and, as such, may prolong the useful life of the bypass sleeve 304, as described in greater detail below. A radially exterior face 534 of the removable bushing 532 may include one or more seals 536 inside one or more grooves 538. The removable bushing 532 is configured to fit securely within the bypass sleeve 304, with the seals 536 forming a seal between the removable bushing 532 and the bypass sleeve 304.

In certain embodiments, a snap ring 540 may be used to lock the removable bushing 532 in place within the bypass sleeve 304. In other embodiments, a pin may be used to limit axial movement of the removable bushing 532 relative to the bypass sleeve 304. The pin may be associated with a spring which biases the pin radially against the removable bushing 532. The removable bushing 532 may be located at any suitable axial location within the bypass sleeve 304. For instance, in the illustrated embodiment, the removable bushing 532 is located toward the bottom of the bypass sleeve 304. However, in other embodiments, the removable bushing 532 may be located toward the top of the bypass sleeve 304. In either of these embodiments, however, the removable bushing 532 will be removable from within the bypass sleeve 304.

In general, the removable bushing 532 may be configured to hold the pressure barrier 255, such as a backpressure valve, in place within an interior volume of the removable bushing 532. As such, in the illustrated embodiment, the pressure-barrier interface 134 may be located on a radially interior face 542 of the removable bushing 532. Due to high pressures generated within the well, strong axially upward forces may be exerted on the bypass sleeve 304. More specifically, whenever the pressure barrier 255 is used, the threading 544 between the pressure-barrier interface 134 and the pressure barrier 255 may be subjected to these axially upward forces. In addition, the corrosive nature of the chemicals used in the well may adversely affect the long-term performance of the threading 544 between the pressure-barrier interface 134 and the pressure barrier 255. However, in the present embodiment, since both the removable bushing 532 and the pressure barrier 255 are removable, any component wear will be limited to components (e.g., the removable bushing 532 and the pressure barrier 255) which may be replaced more easily than, for instance, the bypass sleeve 304 itself. By limiting wear to these easily removable components, overall costs of production may be reduced. In addition, the long-term performance of the bypass sleeve 304 may be improved.

Each of the bypass sleeves and pressure-barrier adapters may be constructed to be a full-bore component. The minimum inner diameters of each of the bypass sleeves and pressure-barrier adapters described above may be generally equal to or larger than the diameter of the production casing 220 (as shown in FIG. 2). For example, in some embodiments, the minimum diameter of certain embodiments may be larger than 5 inches. This is not to suggest, though, that embodiments are limited to full-bore versions of the devices described above.

Further, each of the embodiments described above may be configured to be extractable through a blowout preventer (BOP) or other equipment coupled to a tubing head, such as a frac tree or a christmas tree. In these through BOP-extractable embodiments, the maximum diameter of the bypass sleeves and pressure-barrier adapters described above may be generally equal to or less than the diameter of the blowout preventer or other equipment coupled to the tubing head. For example, in some embodiments, the maximum diameter is less than or generally equal to 8 inches. Again, this is not to suggest that embodiments are limited to through BOP-extractable versions of the devices described above.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a wellhead assembly comprising:

a tubing head having a flange configured to couple to a blowout preventer through a top surface of the flange;

a bypass sleeve disposed substantially entirely within the tubing head and below the top surface of the flange; and a sleeve restraint configured to form a seal within the wellhead assembly above the bypass sleeve, wherein the sleeve restraint comprises a first flange, and the bypass sleeve comprises a second flange that overlaps the first flange, wherein the second flange axially abuts the sleeve restraint, and the first flange is radially outward from the second flange.

2. The system of claim 1, wherein the bypass sleeve comprises a recessed surface configured to receive a distal portion of a locking pin extending from the tubing head.

3. The system of claim 1, comprising a lock ring disposed at least partially around the sleeve restraint.

4. The system of claim 3, comprising an anti-rotation device extending between the wellhead assembly and the sleeve restraint.

5. The system of claim 1, comprising a seal member disposed between the sleeve restraint and the bypass sleeve.

6. The system of claim 1, wherein the tubing head is configured to couple with at least one valve assembly through an exterior wall of the tubing head.

7. A system, comprising:

a wellhead assembly comprising:

a tubular having a flange with a top surface;

a valve coupled to a side wall of the tubular;

a bypass sleeve disposed substantially entirely within the tubular and below the top surface of the flange; and a sleeve restraint configured to form a seal within the wellhead assembly above the bypass sleeve, wherein the sleeve restraint comprises a first flange, and the bypass sleeve comprises a second flange that overlaps the first flange, wherein the first flange is radially outward from the second flange.

8. The system of claim 7, comprising a lock ring disposed at least partially around the sleeve restraint.

9. The system of claim 8, comprising an anti-rotation device extending between the wellhead assembly and the sleeve restraint.

10. The system of claim 7, comprising a seal member disposed between the sleeve restraint and the bypass sleeve.

* * * * *